US005557387A

United States Patent [19]

Hatano

[11] Patent Number: 5,557,387

[45] Date of Patent: Sep. 17, 1996

[54] SHEET CONVEYING DEVICE USING SHEET SUCTION AND AIR FORCED SEPARATION

[75] Inventor: Masaru Hatano, Osaka, Japan

[73] Assignee: Mita Industrial Co. Ltd., Osaka, Japan

[21] Appl. No.: 370,843

[22] Filed: Jan. 10, 1995

[30] Foreign Application Priority Data

Jan. 14, 1994 [JP] Japan ..... 6-015989

[51] Int. Cl.[6] ..... G03G 21/00

[52] U.S. Cl. ..... 355/312; 271/3.07; 271/11; 355/308; 355/309

[58] Field of Search ..... 271/3.01, 3.03, 271/3.05, 3.07, 4.01, 4.05, 4.07, 11, 12; 355/308, 309, 312, 319

[56] References Cited

U.S. PATENT DOCUMENTS

| | | | |
|---|---|---|---|
| 4,570,918 | 2/1986 | Eisler | 271/3.05 |
| 4,632,377 | 12/1986 | Browse | 271/3.01 X |
| 5,071,110 | 12/1991 | Arnone et al. | 271/11 X |
| 5,088,713 | 2/1992 | Hayashi | 271/3.03 |
| 5,090,676 | 2/1992 | Matsuno et al. | 271/12 X |
| 5,152,513 | 10/1992 | Ogasawara et al. | 271/3.07 |
| 5,176,373 | 1/1993 | Namba | 271/3.01 |

*Primary Examiner*—Sandra L. Brase
*Attorney, Agent, or Firm*—Beveridge, DeGrandi, Weilacher & Young, LLP

[57] ABSTRACT

A sheet conveying device conveys sheets by using a suction conveyor belt having small holes. The lowermost sheet stacked on a sheet table is conveyed while being adsorbed on the conveyer belt. A suction fan sucks the lowermost sheet by way of an air suction port formed in a suction duct and the small holes. Sucked air is introduced into an air nozzle through a guide duct. Air blown off from the air nozzle raises the second sheet from the lowermost sheet and the subsequent sheets, to separate the sheets from the lowermost sheet. The suction duct is provided with an auxiliary suction port for ensuring the amount of air blown off from the air nozzle.

16 Claims, 25 Drawing Sheets

SHEET CONVEYING DEVICE USING SHEET SUCTION AND AIR FORCED SEPARATION

CROSS REFERENCE TO RELATED APPLICATION

This application claims priority benefits under 35 USC § 119 of Japanese Patent Application Serial No. 6-15989, the disclosure of which is incorporated by reference.

BACKGROUND OF THE INVENTION

1. Field of the Invention

The present invention relates to a sheet conveying device for sucking and successively conveying the lowermost sheet out of a plurality of sheets put on a sheet table while blowing air on the leading end of the lowermost sheet to separate the lowermost sheet from the other sheets from the downstream side in the direction of conveyance.

2. Disclosure Information

A sheet conveying device for blowing air on sheets such as originals put on a sheet table by an air nozzle and sucking the lowermost sheet by a conveyer belt with small holes to raise the sheets other than the lowermost sheet and separate only the lowermost sheet so that only the lowermost sheet is conveyed by the conveyer belt, thereby to prevent the sheets from being fed while being overlapped with each other has been conventionally known, as described in Japanese Patent Laid-Open Gazette No. 291339/1986.

It seems desirable that air sucked by a suction fan is introduced into the air nozzle and is blown off in the above described sheet conveying device. The reason for this is that an independent fan need not be provided so as to blow air off, and the suction fan can be also used for blowing air off, thereby to make it possible to simplify the construction of the sheet conveying device.

If the suction fan is also used for blowing air off as described above, however, the amount of air blown from the air nozzle is defined as the amount of air sucked through the small holes of the conveyer belt. On the other hand, the small holes of the conveyer belt are covered with the sheet, whereby the amount of air sucked through the small holes is significantly reduced. Therefore, it is expected that the amount of air blown off from the air nozzle is reduced, thereby to make it impossible to prevent the sheets from being fed without overlapping each other.

SUMMARY OF THE INVENTION

Therefore, an object of the present invention is to provide a sheet conveying device whose construction can be simplified and which can reliably prevent sheets from being fed wile being overlapped with each other.

In order to attain the above described object, a sheet conveying device according to one aspect of the present invention is characterized by comprising:

a sheet table on which a plurality of sheets are stacked;

suction conveyer belt means comprising an endless suction conveyer belt having a plurality of small holes for successively conveying a lowermost sheet out of the sheets stacked on the sheet table along a conveying direction;

a suction duct disposed with it crossing the suction conveyer belt in a loop of the suction conveyer belt and having an air suction port in communication with the plurality of small holes formed on its upper surface;

sucking means for sucking air through the suction duct;

an air nozzle for blowing air on a leading end of the lowermost sheet to separate upper sheets from the lowermost sheet;

a guide duct for introducing the air sucked from the suction duct into the air nozzle; and an auxiliary suction port for ensuring in the suction duct an amount of air blown off from the air nozzle.

In accordance with the aspect, the air sucked by the sucking means through the suction duct is introduced into the air nozzle through the guide duct, and is blown on the leading end of the lowermost sheet from the air nozzle. If the sheet is adsorbed on the suction conveyer belt by suction from the small holes, the small holes are covered with the sheet, whereby the amount of air sucked through the air suction port of the suction duct is significantly reduced. However, the air is sucked into the suction duct through the auxiliary suction port, thereby to make it possible to ensure the amount of air blown off from the air nozzle.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 7A illustrates a state where an original has not been adsorbed on suction conveyer belts yet at the time of starting the suction of air, and FIG. 7B illustrates a state where an original is adsorbed on the suction conveyer belts after starting the suction of air;

FIG. 14A illustrates a state where a suction fan is started, and FIG. 14B illustrates a state where the first paper sheet has been stacked;

FIG. 15A illustrates a state where a valve is opened, and FIG. 15B illustrates a state where the paper sheet is adsorbed on suction conveyer belts;

DETAILED DESCRIPTION OF THE PREFERRED EMBODIMENTS

Embodiments will be described in detail with reference to the attached drawings.

Figure 2:
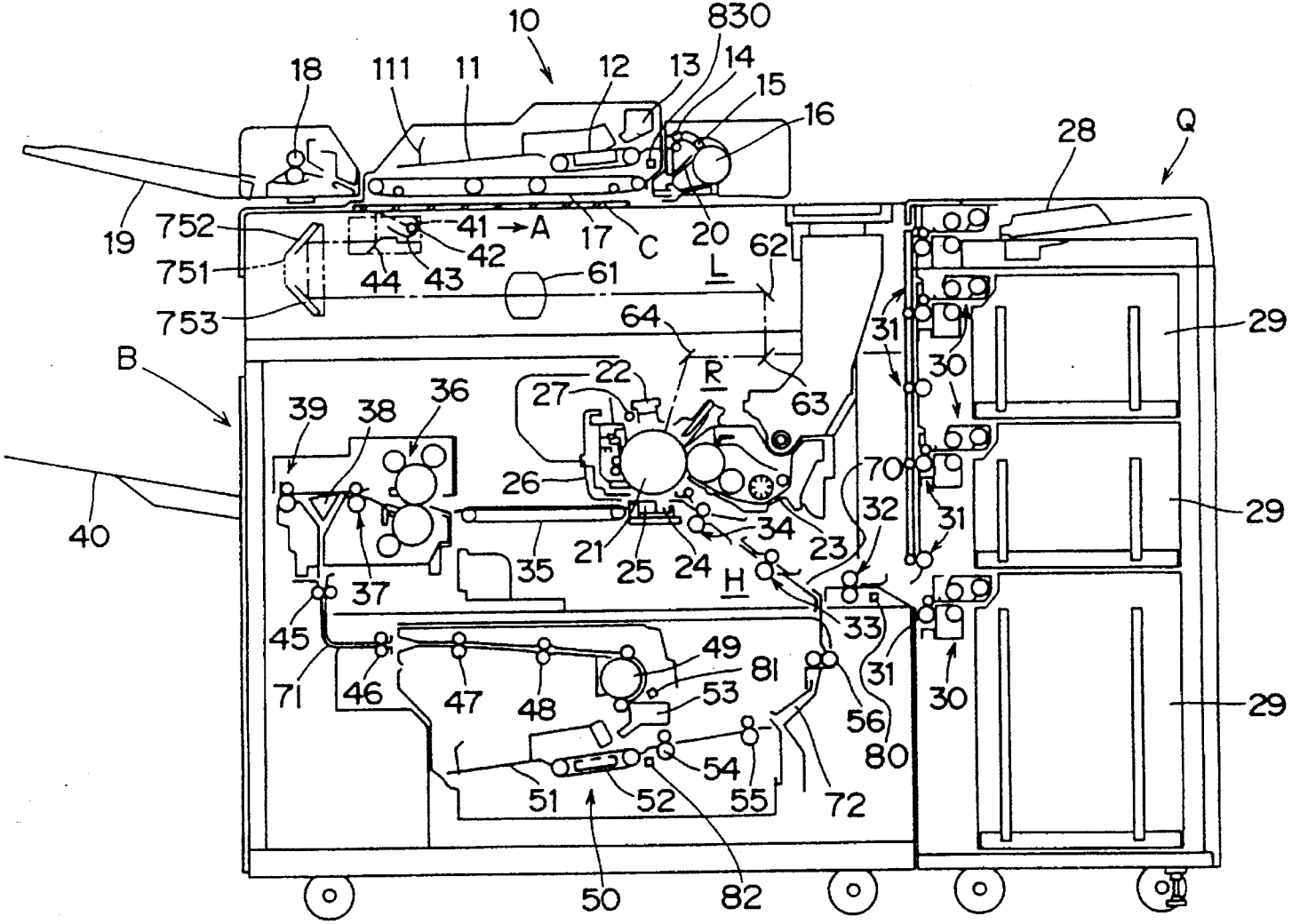
FIG. 2 is a schematic structural view showing an inner cross section of an image forming apparatus.

Referring to FIG. 2, an image forming apparatus comprises (1) a main body B, (2) a contact glass C serving as a transparent platen and a reversing automatic document feeder (RADF) 10 capable of reversing an original which is disposed on the upper surface of the main body B, (3) an optical system L, an image forming section R, a paper refeeding device 50 and a paper conveying section H which is disposed inside of the main body B, and (4) a paper feeding device Q disposed beside the main body B.

The above described reversing automatic document feeder 10 comprises an original platen 11, a suction conveyer belt 12, an air nozzle 13, delivery rollers 14 and 15, a reversing roller 16, a conveyer belt 17, a pair of discharge rollers 18 and, a paper discharge tray 19, and the like. In the reversing automatic document feeder 10, in the case of copying one-sided originals, the lowermost original out of a plurality of originals put on the original platen 11 is separated from the originals other than the lowermost original by suction using the suction conveyer belt 12 and blow-off of air from the air nozzle 13, and is conveyed onto the contact glass C by the suction conveyer belt 12, the delivery rollers 14 and 15, the reversing roller 16 and the conveyer belt 17. A paper trailing end linear 111 for lining up the trailing ends of the originals put on the original platen 11 is slidably provided on the original platen 11. Reference numeral 830 denotes an original passage detecting sensor for detecting the passage of the original conveyed from the original platen 11.

The original on the contact glass C is scanned by the optical system L, after which the scanned original is discharged to the paper discharge tray 19 by the conveyer belt 17 and the pair of discharge rollers 18. On the other hand, in the case of copying double-sided originals, the surface of the original is scanned by the optical system L, after which the scanned original is conveyed again by the conveyer belt 17 through a guide 20 to the reversing roller 16, where the original is reversed. The reverse surface of the original is conveyed so as to be opposed to the contact glass C and is scanned by the optical system L in this state, after which the scanned original is discharged to the discharge tray 19 by the same operation as that in the above described case of copying one-sided originals. The detailed construction of the suction conveyer belt 12 and the air nozzle 13 will be described later.

The optical system L comprises a first moving frame 41 comprising a halogen lamp 42, a reflecting plate 43 and a mirror 44, a second moving frame 751 comprising mirrors 752 and 753, and a lens section 61, and fixed mirrors 62, 63 and 64. The optical system L causes the halogen lamp 42 to emit light if a copying operation is started, and moves the moving frames 41 and 751 at respective predetermined speeds in the direction of scanning (the direction of A in FIG. 2) so as to scan the original on the contact glass C. The original on the contact glass C is irradiated by the light from the halogen lamp 42. The light is reflected from the original, and is introduced into the lens section 61 through the mirrors 44, 752 and 753, to expose a photosensitive drum 21.

The image forming section R comprises the photosensitive drum 21, a charging section 22 provided around the photosensitive drum 21, a developing section 23, a transferring section 24, a separating section 25, a cleaning section 26 and, a charge eliminating section 27, and the like. The periphery of the photosensitive drum 21 is charged to a predetermined potential by the charging section 22, whereby an electrostatic latent image of the original is formed by the exposure. The electrostatic latent image is developed into a toner image by the adhesion of charged toner particles in the developing section 23. The toner image is transferred onto paper sheets conveyed from the paper feeding device Q.

The paper feeding device Q comprises a manual paper setting section 28, a plurality of paper feeding sections 29, a group of pairs of paper feeding rollers 30 and, a group of pairs of delivery rollers 31, and the like. In the paper feeding device Q, paper sheets are fed to a pair of delivery rollers 32 from the manual paper setting section 28 or the paper feeding section 29 by the group of pairs of paper feeding rollers 30 and the group of pairs of delivery rollers 31.

Furthermore, a pair of delivery rollers 33, a pair of registration rollers 34, a conveyer belt 35, a fixing device 36, a pair of delivery rollers 37, a switching guide 38, a pair of paper discharge rollers 39 and, a paper discharge tray 40, are disposed in this order from the upstream side in the direction of conveyance as the paper conveying section H. In the paper conveying section H, paper sheets are fed to the photosensitive drum 21 from the paper feeding device Q by the pair of delivery rollers 32 and 33 and the pair of registration rollers 34, and toner particles on the photosensitive drum 21 are transferred on the paper sheet when the paper sheet passes through the position of the transferring section 24.

In the case of copying on one side of the paper sheet, the paper sheet on which a toner image is transferred is separated from the photosensitive drum 21 by the separating section 25, is conveyed by the conveyer belt 35 to the fixing device 36, where the toner image is fixed, after which the paper sheet is discharged to the discharge tray 40 by the pair of delivery rollers 37 and the pair of discharge rollers 39. On the other hand, in the case of copying on both sides of the paper sheet, the switching guide 38 is switched to the paper refeeding device 50, and the paper sheet, after the fixing, is conveyed to the paper refeeding device 50 through a stacking and conveying path 71 from the switching guide 38.

The paper refeeding device 50 comprises pairs of delivery rollers 45 to 48, a reversing roller 49, a sheet table 51, a suction conveyer belt 52, an air nozzle 53 and, pairs of delivery rollers 54 to 56 in this order from the upstream side in the direction of conveyance. The paper sheet is conveyed to the reversing roller 49 by the pairs of delivery rollers 45 to 48, and is stacked on the sheet table 51 with its reverse surface directed downward by the reversing roller 49. A conveying path from the pair of delivery rollers 45 to the sheet table 51 is the above described stacking and conveying path 71.

If a copying operation on the reverse surface of the paper sheet is started, only the lowermost paper sheet out of a plurality of paper sheets stacked on the sheet table 51 is separated from the paper sheets other than the lowermost paper sheet by suction using the suction conveyer belt 52 and blow-off of air from the air nozzle 53, the separated lowermost paper sheet is fed to the photosensitive drum 21 through a paper refeeding path 72 by the suction conveyer belt 52 and the pairs of delivery rollers 54 to 56, and the toner image on the photosensitive drum 21 is transferred to the reverse surface of the paper sheet when the paper sheet passes through the transferring section 25. The paper sheet on which the toner image is transferred is separated from the photosensitive drum 21 by the separating section 26, is conveyed by the conveyer belt 35 to the fixing device 36, where the toner image is fixed, after which the paper sheet is introduced into the pair of paper discharge rollers 39 after passing through the pair of delivery rollers 37 through the switching guide 38 which is returned to the discharge side, and is discharged into the paper discharge tray 40. A path from the sheet table 51 to a primary paper feeding path 70 is the paper refeeding path 72.

A paper feeding detecting sensor 80 for detecting the passage of the fed paper sheet is disposed in a leading end portion of the primary paper feeding path 70 and in a position just on the upstream side of the pair of delivery rollers 32. Further, a first paper passage detecting sensor 81 for detecting the passage of the paper sheet is disposed in a trailing end portion of the stacking and conveying path 71 and in a position obliquely below the reversing roller 49. The first paper passage detecting sensor 81 detects the passage of the paper sheet immediately before being stacked on the sheet table 51. In addition, a second paper passage detecting sensor 82 for detecting the passage of the paper sheet is disposed in a leading end portion of the paper refeeding path 72 and between the suction conveyer belt 52 and the pair of delivery rollers 54. The second paper passage detecting sensor 82 detects the passage of the paper sheet immediately after being fed again. Each of the sensors 80 to 82 is constituted by a photosensor, a limit switch or the like.

Figure 1:
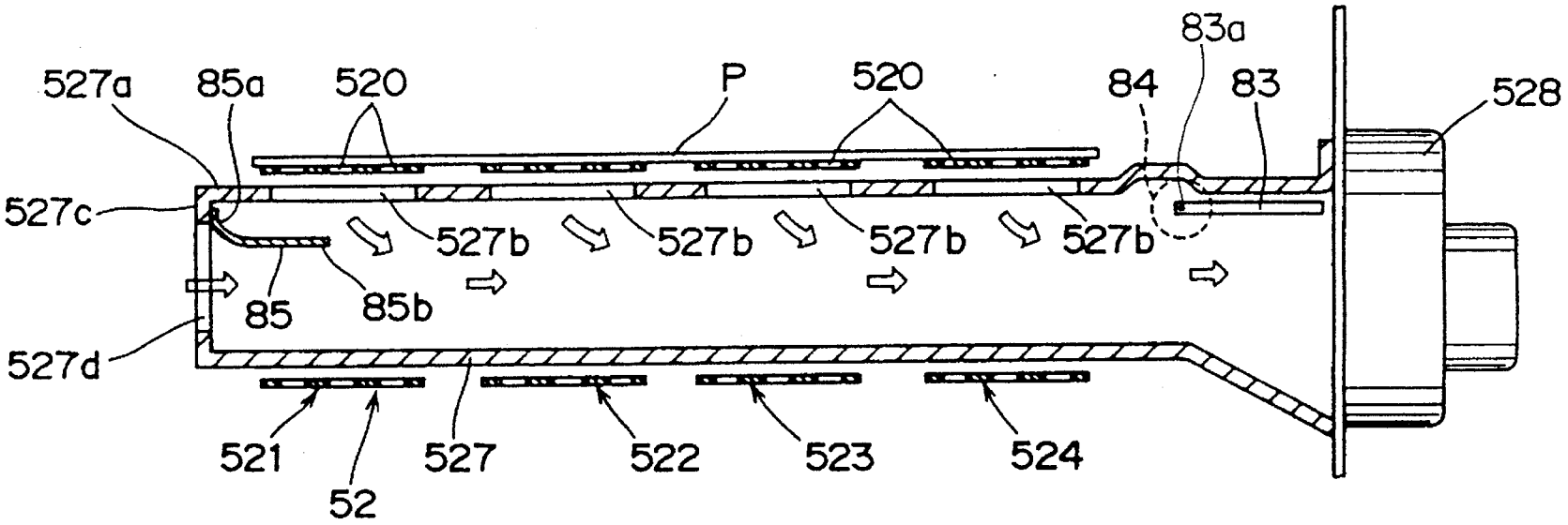
FIG. 1 is a longitudinal sectional view showing a suction duct in a paper refeeding device according to one embodiment of the present invention, which is taken along a line I—I shown in FIG. 3 and illustrates a state where an auxiliary suction port is opened by a lamina.
Figure 3:
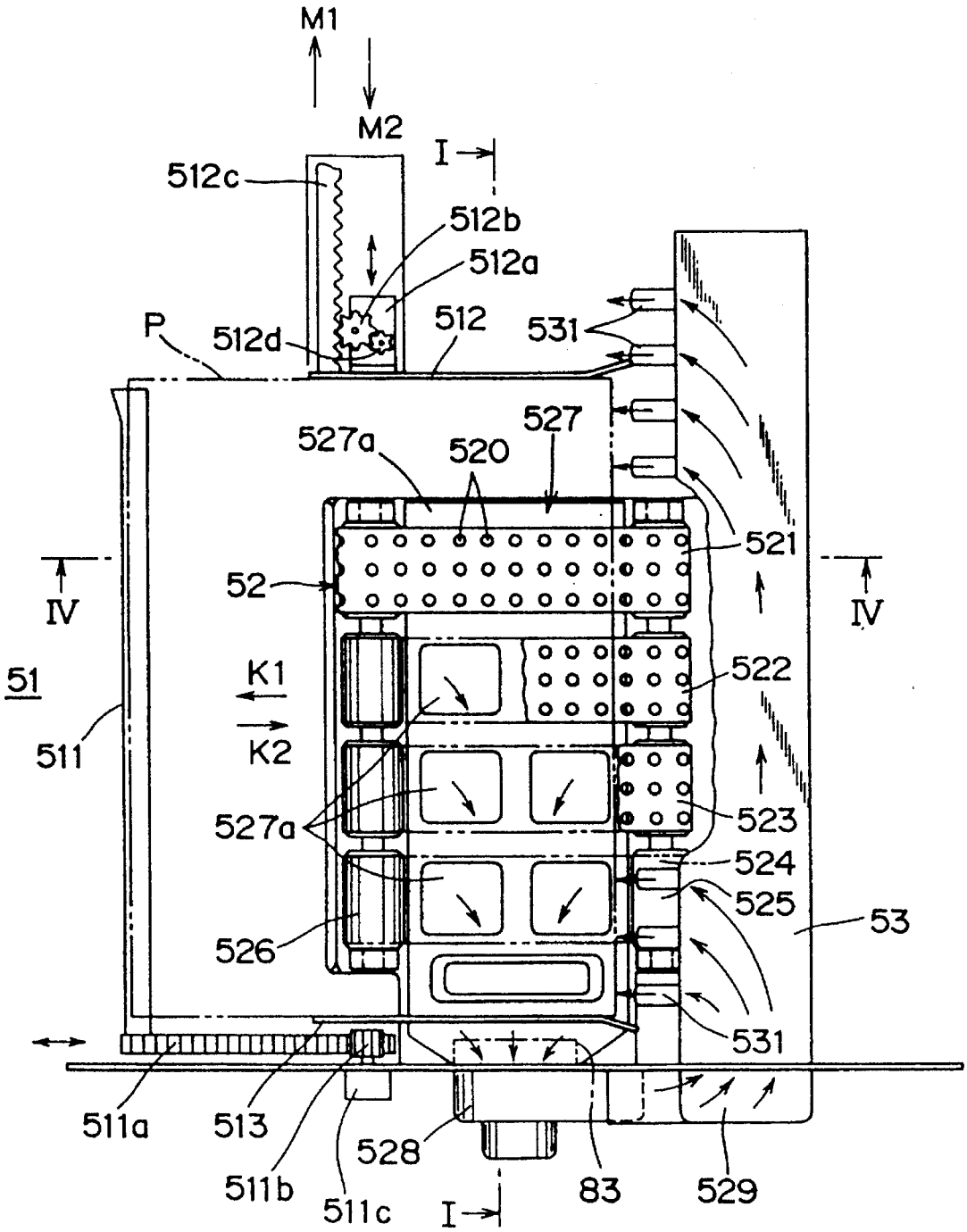
FIG. 3 is a partially cutaway plan view showing a principal part of the paper refeeding device.
Figure 4:
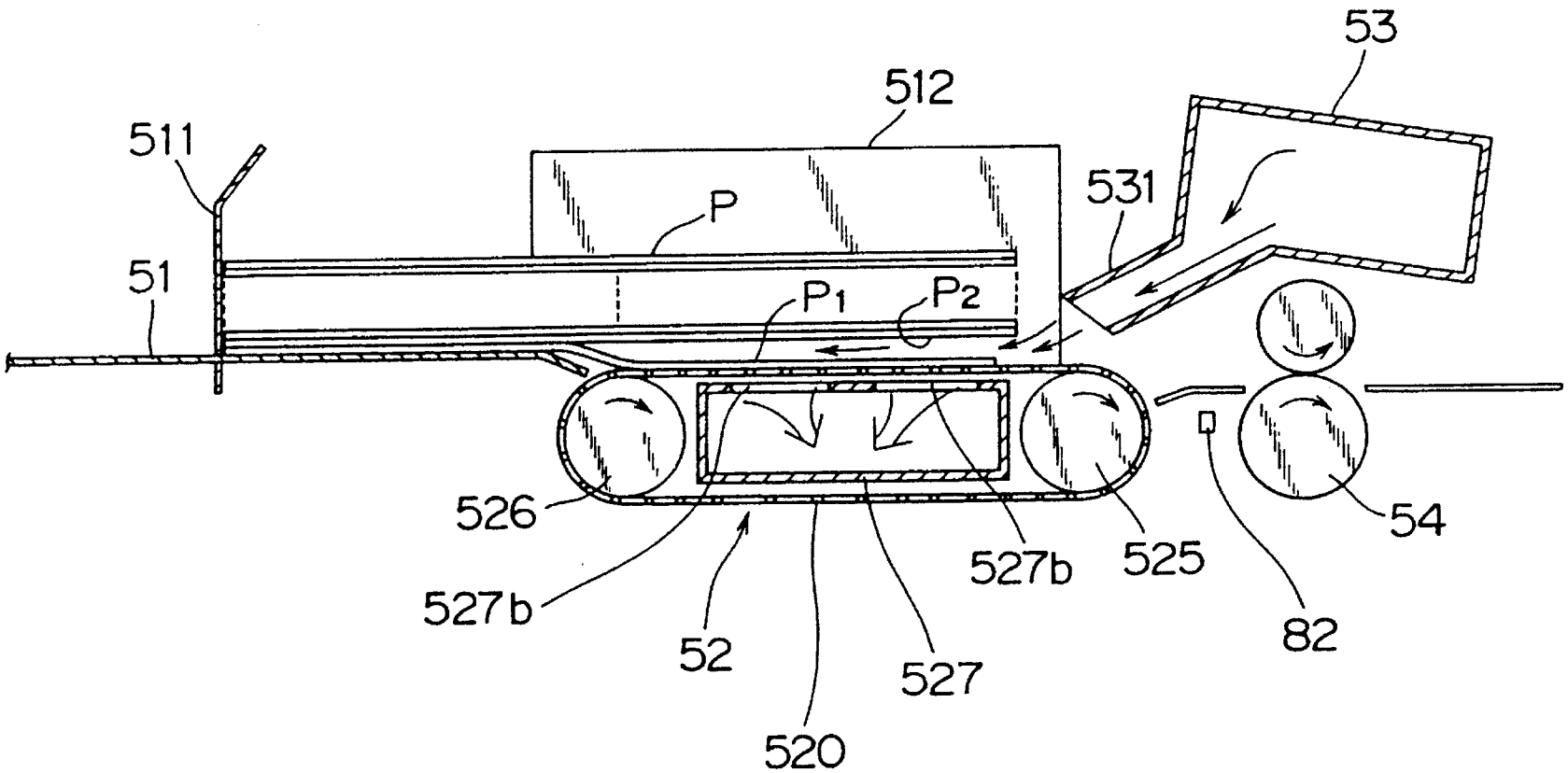
FIG. 4 is a cross sectional view showing the paper refeeding device, which is taken along a line IV—IV shown in FIG. 3.

The detailed construction of the suction conveyer belt 52 and the air nozzle 53 in the paper refeeding device 50 will be described using FIG. 4 showing a cross section taken along a line IV—IV in FIG. 3 and FIG. 1 showing a cross section taken along a line I—I in FIG. 3.

Referring to FIG. 3, a paper leading end linear 511 automatically slid in the direction of conveyance (the directions K1 and K2) of paper sheets P conveyed by the suction conveyer belt 52 depending on the set paper size for lining up the leading ends of the paper sheets P (the leading ends in a case where they are stacked and the trailing ends in a case where they are fed again) and a paper side end linear 512 automatically slid in the direction of the width of the paper sheets P depending on the set paper size for lining up both side ends of the paper sheets P are respectively disposed on the sheet table 51 so as to line up the paper sheets P. Reference numeral 513 denotes a paper side end linear fixed to the sheet table 51.

The paper leading end linear 511 is so adapted as to be slidable integrally with a rack 511*a* which is disposed in the direction of conveyance of the paper sheets P. A pinion 511*b* which is rotated by a motor 511*c* fixed to a side plate is engaged with the rack 511*a*. The paper leading end linear 511, along with the rack 511*a*, is slidably moved to a required position corresponding to the paper size by the driving of the motor 511*c*.

The above described paper side end linear 512, along with a mounting member 512*a*, is slid in the directions M1 and M2 orthogonal to the directions of conveyance K1 and K2 of the paper sheets P. A pinion 512*b* is mounted on the mounting member 512*a* so as to be rotatable and movable integrally with the mounting member 512*a*. The pinion 512*b* is engaged with a rack 512*c* fixed to the sheet table 51. In addition, a motor for rotating the pinion 512*b* through a gear 512*d*, which is not illustrated, is mounted on the mounting member 512*a*. The paper side end linear 512, along with the pinion 512*b* and the mounting member 512*a*, is slidably moved to a required position corresponding to the paper size by the driving of the motor.

Referring to FIGS. 3 and 4, four suction conveyer belts 521 to 524 are disposed in parallel as the above described suction conveyer belt 52 in the direction of the width of the sheet table 51. The suction conveyer belts 521 to 524 are stretched between a driving roller 525 and a driven roller 526. The suction conveyer belts 521 to 524 and the driving roller 525 and the driven roller 526 between which the suction conveyer belts 521 to 524 are stretched constitute conveyer belt means. Each of the suction conveyer belts 521 to 524 is provided with a plurality of small holes 520, regularly for example. In addition, a suction duct 527 in a hollow box shape is disposed between the driving roller 525 and the driven roller 526. A plurality of air suction ports 527*b* narrower than the suction conveyer belts 521 to 524 are provided on an upper surface 527*a* of the suction duct 527 and in positions opposed to the respective suction belts 521 to 524.

A suction fan 528 containing a fan motor which serves as sucking means is connected to one end surface of the suction duct 527. A portion of the suction fan 528 on the side of the exhaust of air is connected to the air nozzle 53 through a guide duct 529. The air nozzle 53 is disposed on the downstream side of the sheet table 51 in the direction of conveyance of paper sheets. The air nozzle 53 has a plurality of air blow-off ports 531 arranged in the direction of the width of the sheet table 51. Each of the air blow-off ports 531 is directed toward portions of the suction conveyer belts 521 to 524 on the side of the driving roller 525 and is so adapted as to blow air sent through the guide duct 529 off.

Furthermore, the upper surfaces of the suction conveyer belts 521 to 524 have steps from a surface of the sheet table 51 on which paper sheets are put and is so adapted as to cause a clearance between the lowermost paper sheet $P_1$ on the sheet table 51 and the second paper sheet $P_2$ from the lowermost paper sheet when the lowermost paper sheet $P_1$ is sucked through the air suction port 527*b* of the suction duct 527 and the small holes 520 of the suction conveyer belts 521 to 524 so that the air from the air nozzle 53 enters the clearance. The second paper sheet $P_2$ from the lowermost paper sheet and the subsequent paper sheets P are raised by the pressure of the air from the air nozzle 53, whereby the lowermost paper sheet $P_1$ is reliably separated from the paper sheets P other than the lowermost paper sheet $P_1$, and only the lowermost paper sheet $P_1$ is conveyed by the suction conveyer belts 521 to 524.

Figure 14A:
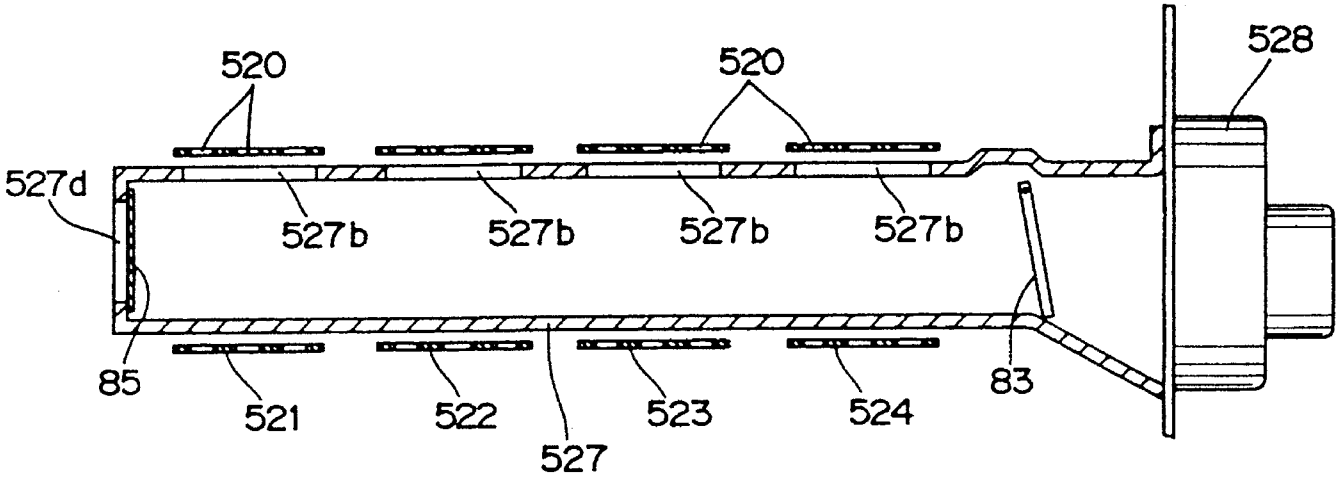
FIGS. 14A and FIG. 14B are cross sectional views showing a suction duct, where
Figure 14B:
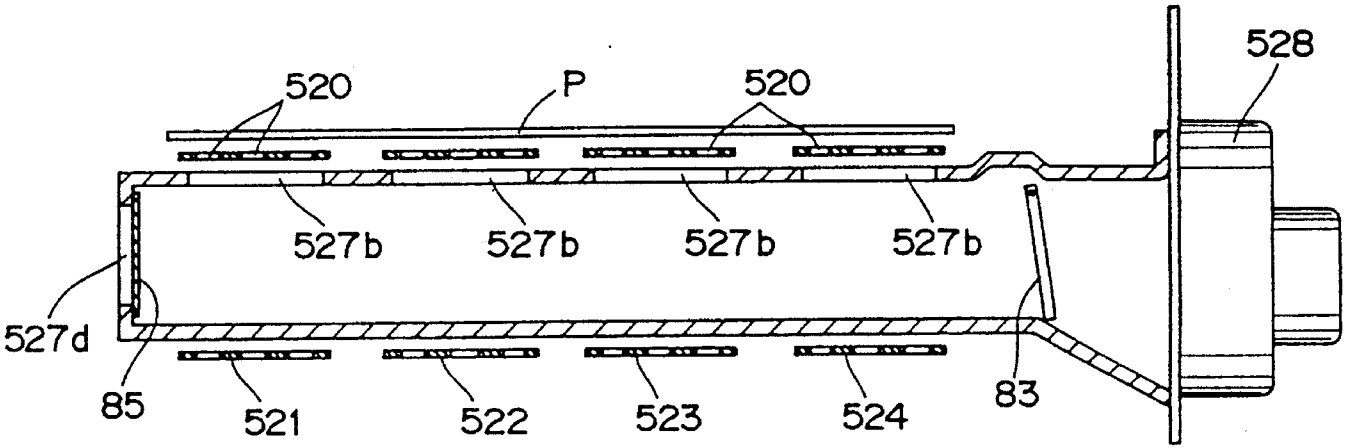

Referring to FIG. 1, an auxiliary suction port 527*d*, for ensuring the amount of air blown off from the air nozzle 53 is provided on the other end surface of the suction duct 527. That is, the auxiliary suction port 527d is disposed in a portion of the suction duct 527 on the upstream side of the air suction port 527*b* in the direction of suction. In addition, the auxiliary suction port 527*d* is so adapted as to be opened and closed by a lamina 85 which is a thin plate member serving as a valve. The lamina 85 is composed of a synthetic resin film, a synthetic resin sheet or the like, and has predetermined elasticity. An upper end 85*a* of the lamina 85 is affixed to an inner surface of the suction duct 527, and a lower end 85*b* thereof is a free end. The lamina 85 closes the auxiliary suction port 527*d*, as shown in FIGS. 14A and 14B, if a pressure differential across the auxiliary suction port 527*d* is less than a predetermined value, while being curved using the upper end 85*a* as a supporting point to open the auxiliary suction port 27*d*, as shown in FIG. 1, if the pressure differential across the auxiliary suction port 527*d* is not less than the predetermined value.

Furthermore, as shown in FIG. 1, a butterfly valve 83 capable of opening and closing an air path in the suction duct 527 is provided in a portion between the air suction port 527*b* in the suction duct 527 and the suction fan 528. The valve 83 is rotated around an axis of rotation 83*a* by a valve driving motor 84, to be displaced to a closed attitude as shown in FIGS. 14A and 14B and an opened attitude as shown in FIG. 1.

The suction fan 528 is started and the valve 83 is closed a predetermined time period before the time at which the first paper sheet P should be sucked and conveyed (before the first paper sheet P is stacked on the sheet table 51), and the valve 83 is opened at the time at which the first paper sheet P should be sucked and conveyed, to immediately start the suction and conveyance. A certain degree of time is required until a predetermined amount of sucked air is ensured from the start of the suction fan 528, and the time when no paper sheets can be conveyed becomes lost time. The suction fan 528 is started slightly earlier than the above described stand by time to make it possible to eliminate the above described loss time. If the suction fan 528 is started slightly earlier as described above, however, the first paper sheet P is prevented from being stacked on the sheet table 51 by the suction of air so that it cannot be stacked in the regular position. Therefore, the valve 83 is closed in a state where the suction fan 528 is operated in standby so that the first paper sheet P is not affected by the suction of air.

Figure 5:
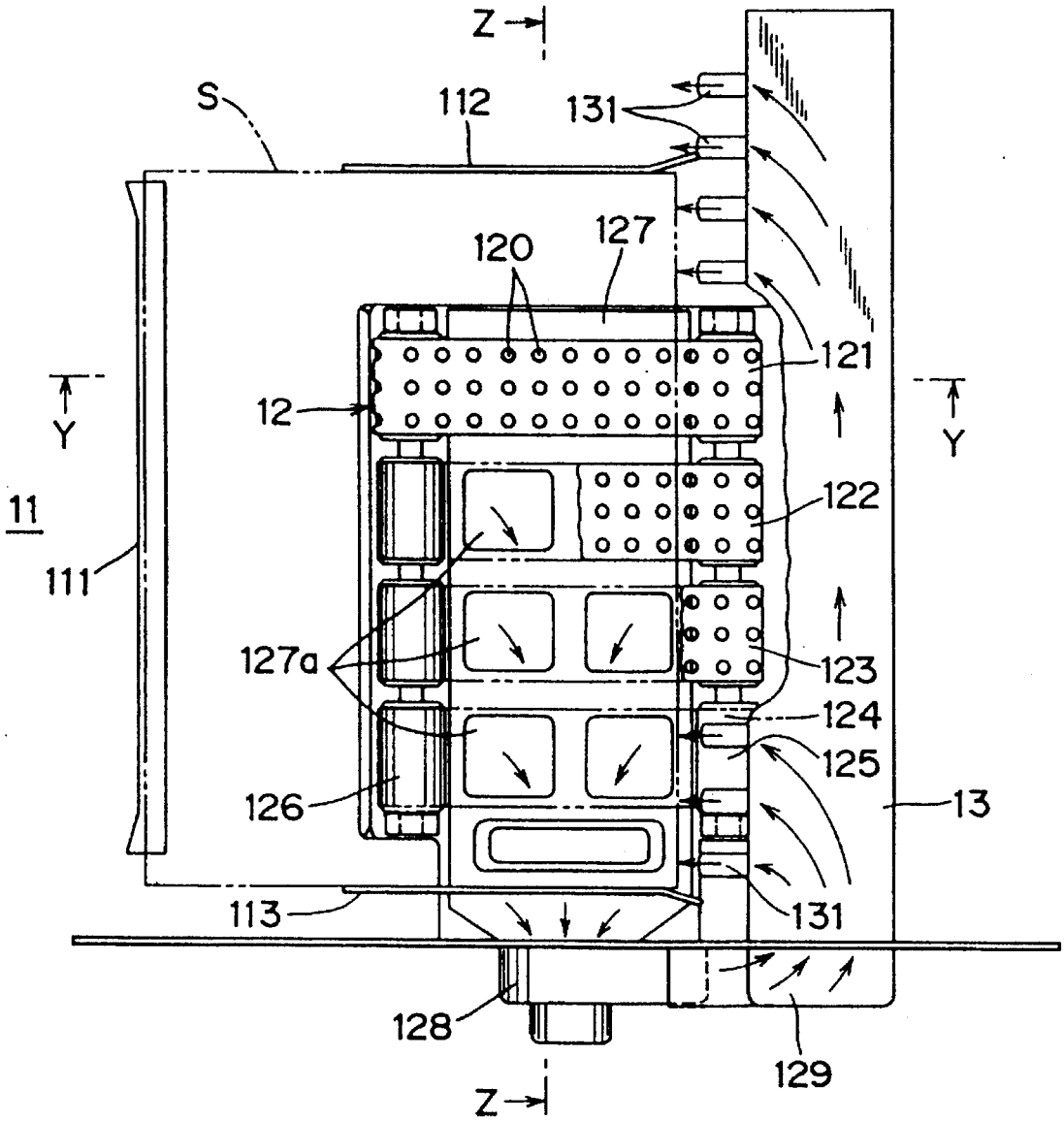
FIG. 5 is a partially cutaway plan view showing a principal part of an automatic document feeder.
Figure 6:
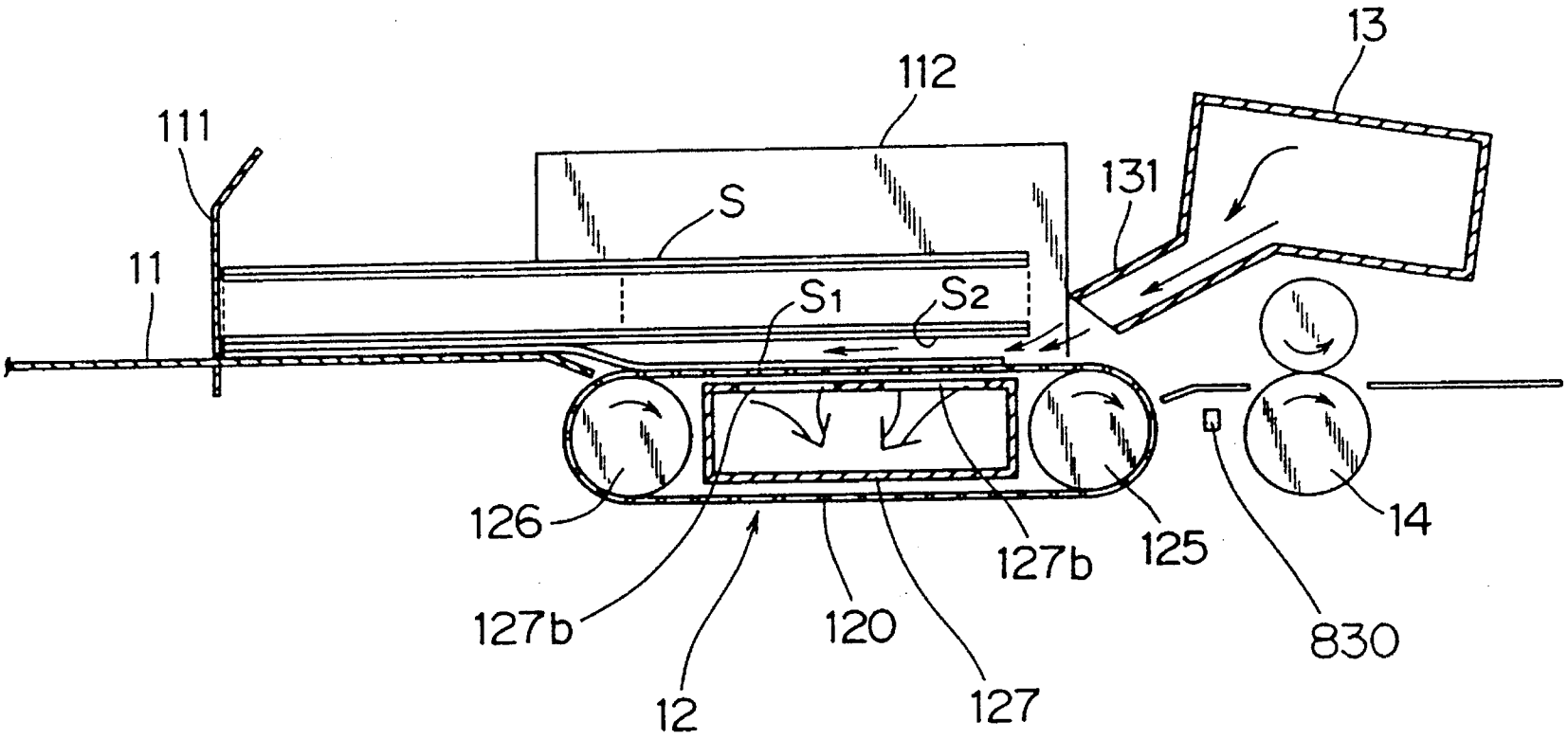
FIG. 6 is a cross sectional view showing the automatic document feeder, which is taken along a line Y—Y shown in FIG. 5.

Referring to FIGS. 5 to 7, description is now made of the reversing automatic document feeder 10. The suction conveyer belt 12 and the air nozzle 13 in the reversing automatic document feeder 10 employ the same construction as that in the paper refeeding device 50 previously described (FIG. 5 corresponds to FIG. 3, FIG. 6 corresponds to FIG. 4, and FIG. 7 corresponds to FIG. 1). The above described paper refeeding device 50 and the reversing automatic document feeder 10 differ mainly in the following points (1) to (2).

(1) In the above described paper refeeding device 50, the paper trailing end linear 511 and the paper side end linear 512 are automatically slid, whereby the driving mechanisms 511*a* to 511*c* and 512*a* to 512*d* are provided. On the other hand, in the reversing automatic document feeder 10, the paper trailing end linear 111 and the paper side end linear 112 are manually slid, whereby no mechanisms corresponding to the driving mechanisms are provided.

(2) In the above described paper refeeding device 50, the paper sheet is conveyed in the direction K1 and is stacked and then, is conveyed in the direction K2 opposite to the direction K1. On the other hand, in the reversing automatic document feeder 10, an original set by a person is only conveyed in the direction K2.

Figure 7A:
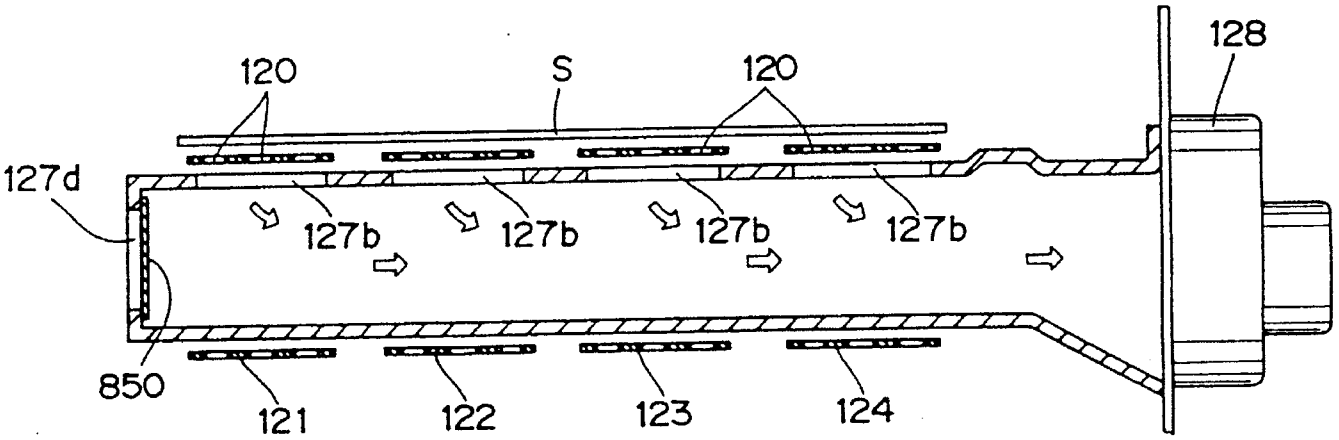
FIGS. 7A and 7B are cross sectional views showing the automatic document feeder, which are taken along a line Z—Z shown in FIG. 5, where
Figure 7B:
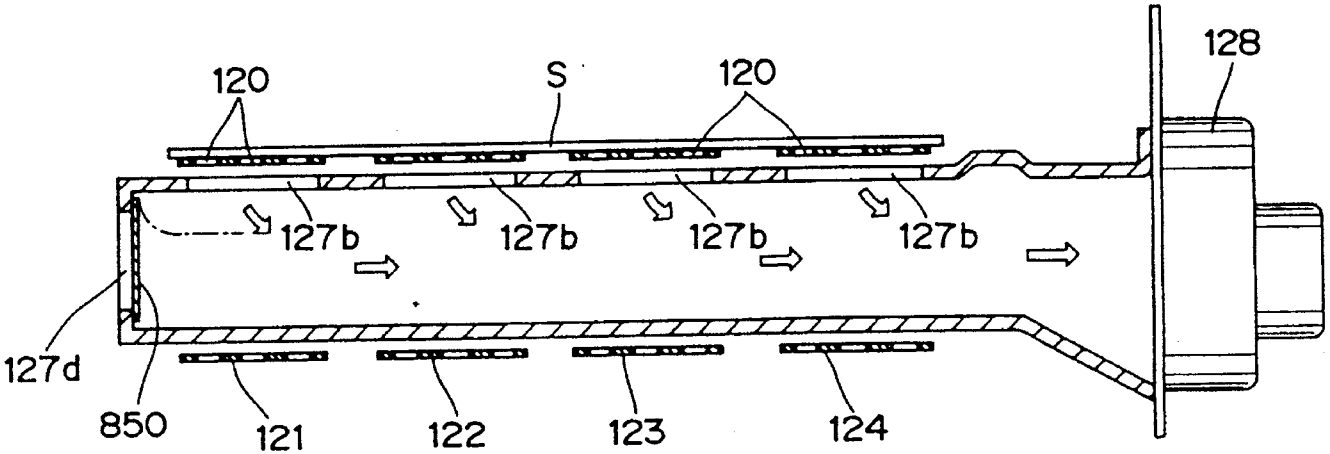

As to the other construction, the original platen 11, the suction conveyer belt 12 (121 to 124), small holes 120, a driving roller 125, a driven roller 126, a suction duct 127, an upper surface 127*a*, air suction ports 127*b*, the other end surface 127*c*, an auxiliary suction port 127*d*, a suction fan 128, a guide duct 129, an air nozzle 13, air blow-off ports 131, and a lamina 850 in the reversing automatic document feeder 10 respectively correspond to the original platen 51, the suction conveyer belt 52 (521 to 524), the small holes 520, the driving roller 525, the driven roller 526, the suction duct 527, the upper surface 527*a*, the air suction ports 527*b*, the other end surface 527*c*, the auxiliary suction port 527*d*, the suction fan 528, the guide duct 529, the air nozzle 53, the air blow-off ports 531, and the lamina 85 in the above described paper refeeding device 50. FIG. 7A illustrates a state where suction is started, and FIG. 7B illustrates a state where the lamina 850 has closed the auxiliary suction port 127*d* immediately after the suction is started and immediately after an original S is sucked by the suction conveyer belts 121 to 124. Thereafter, the lamina 850 opens the auxiliary suction port 127*d*, as indicated by a one-dot and dash line in FIG. 7B.

Figure 8:
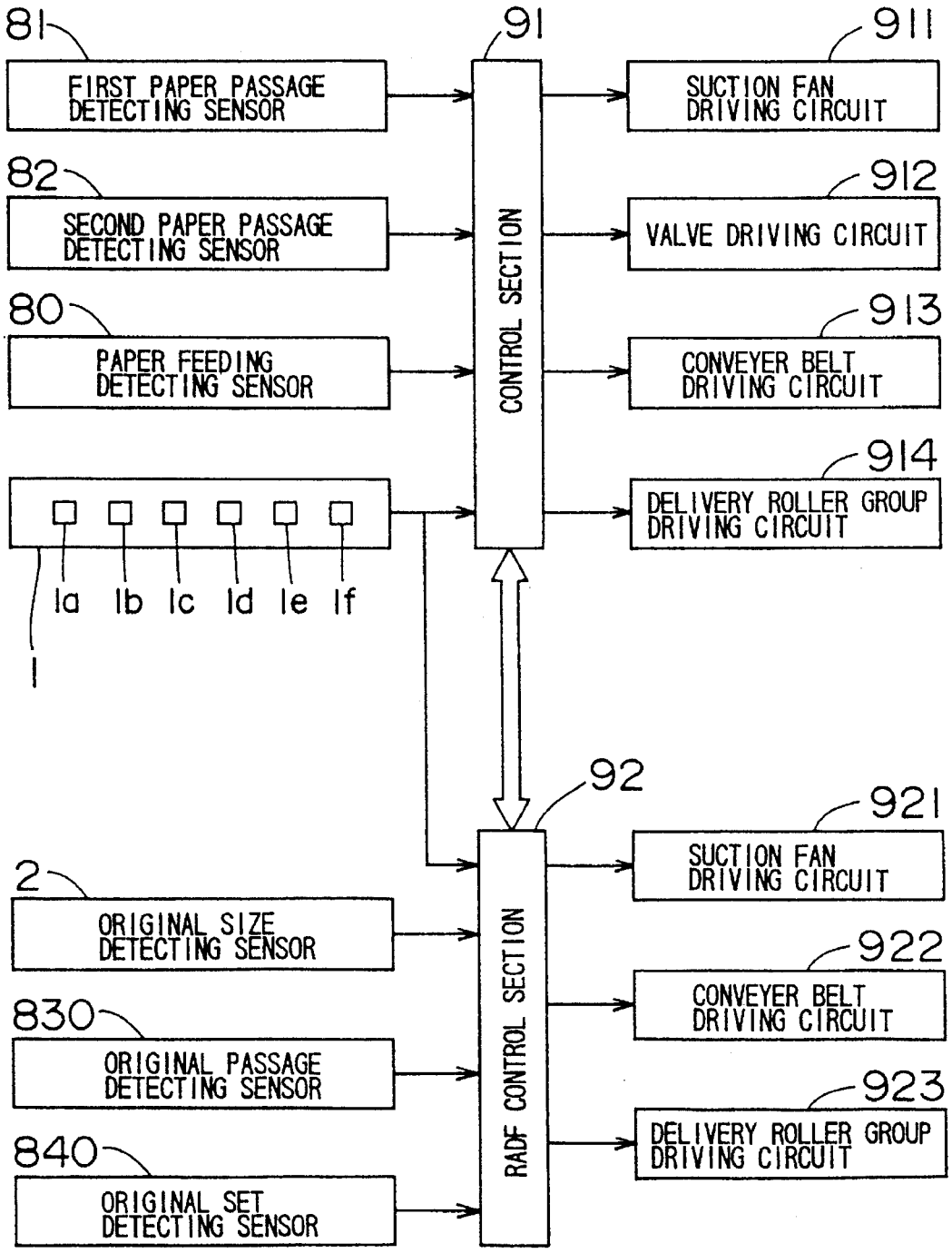
FIG. 8 is a block diagram showing the electrical construction of the image forming apparatus.
Figure 9:
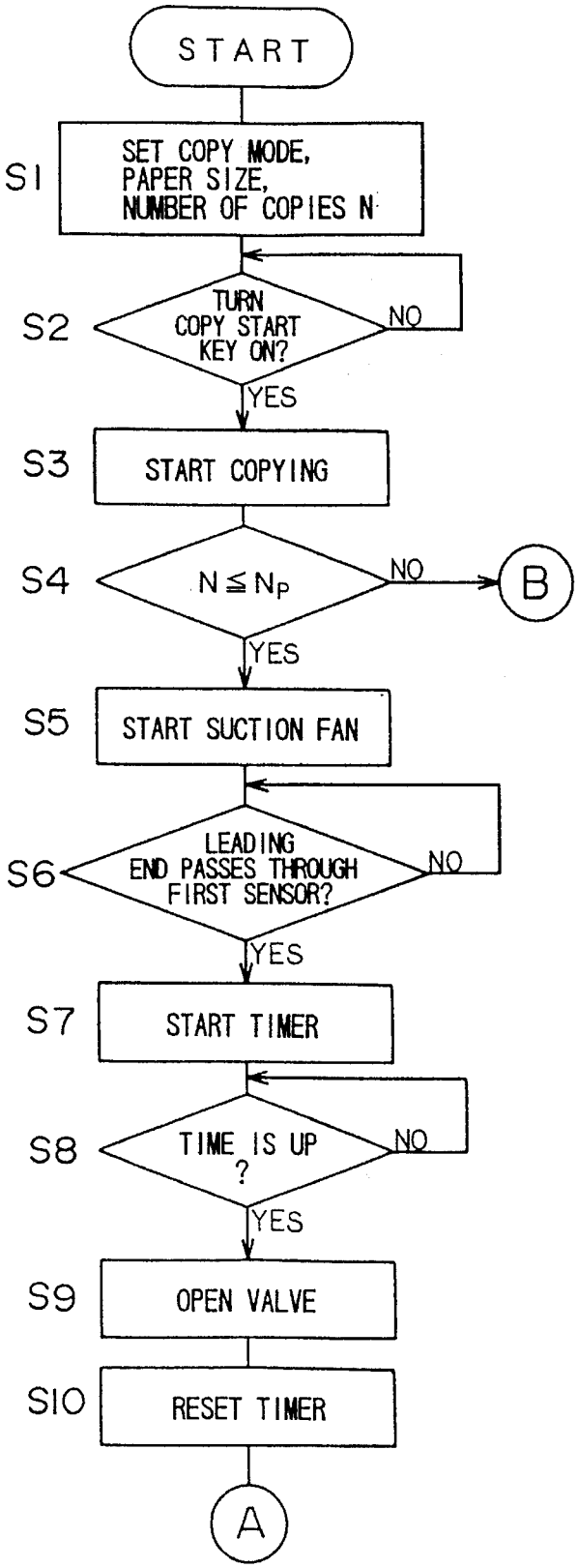
FIG. 9 is a flow chart showing the flow of control at the time of a refeeding operation.
Figure 10:
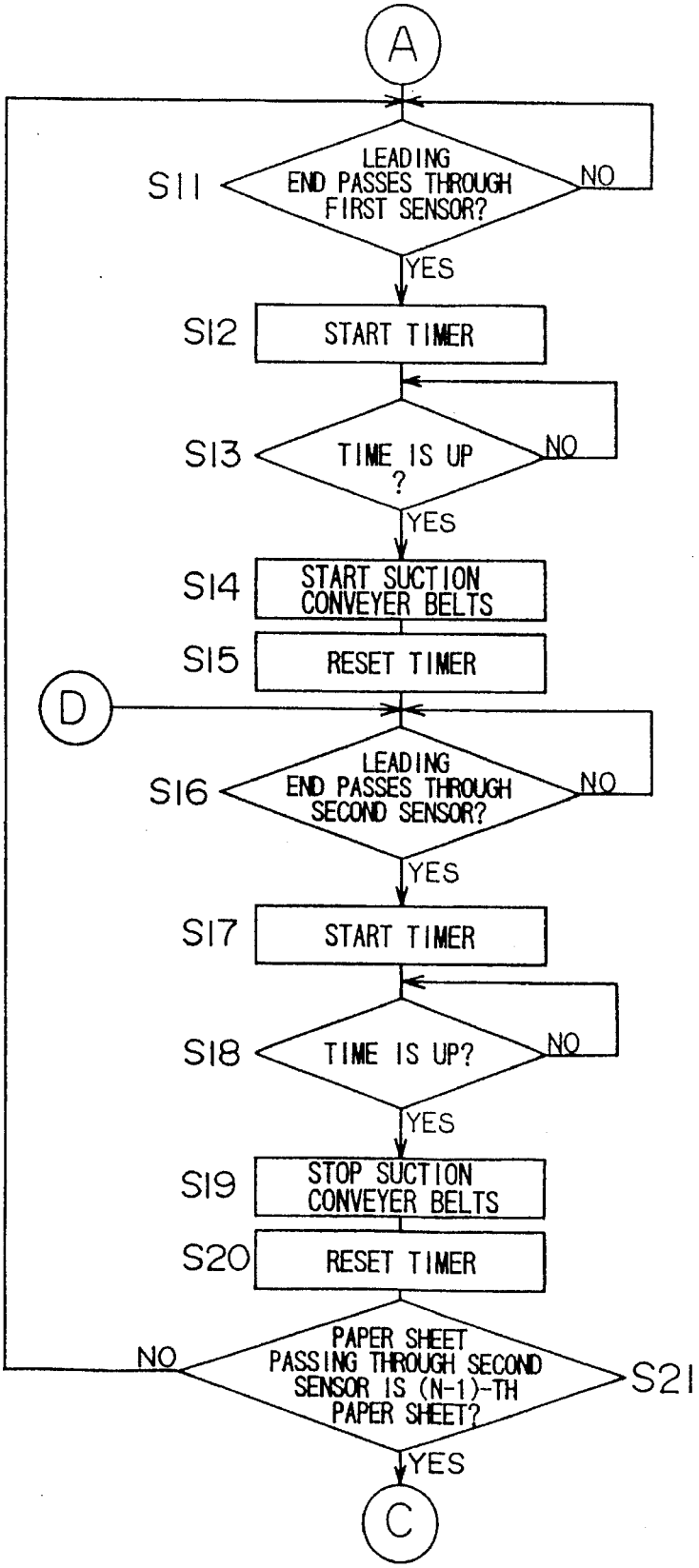
FIG. 10 is a flow chart showing the flow of control subsequently to the flow chart of FIG. 9.
Figure 11:
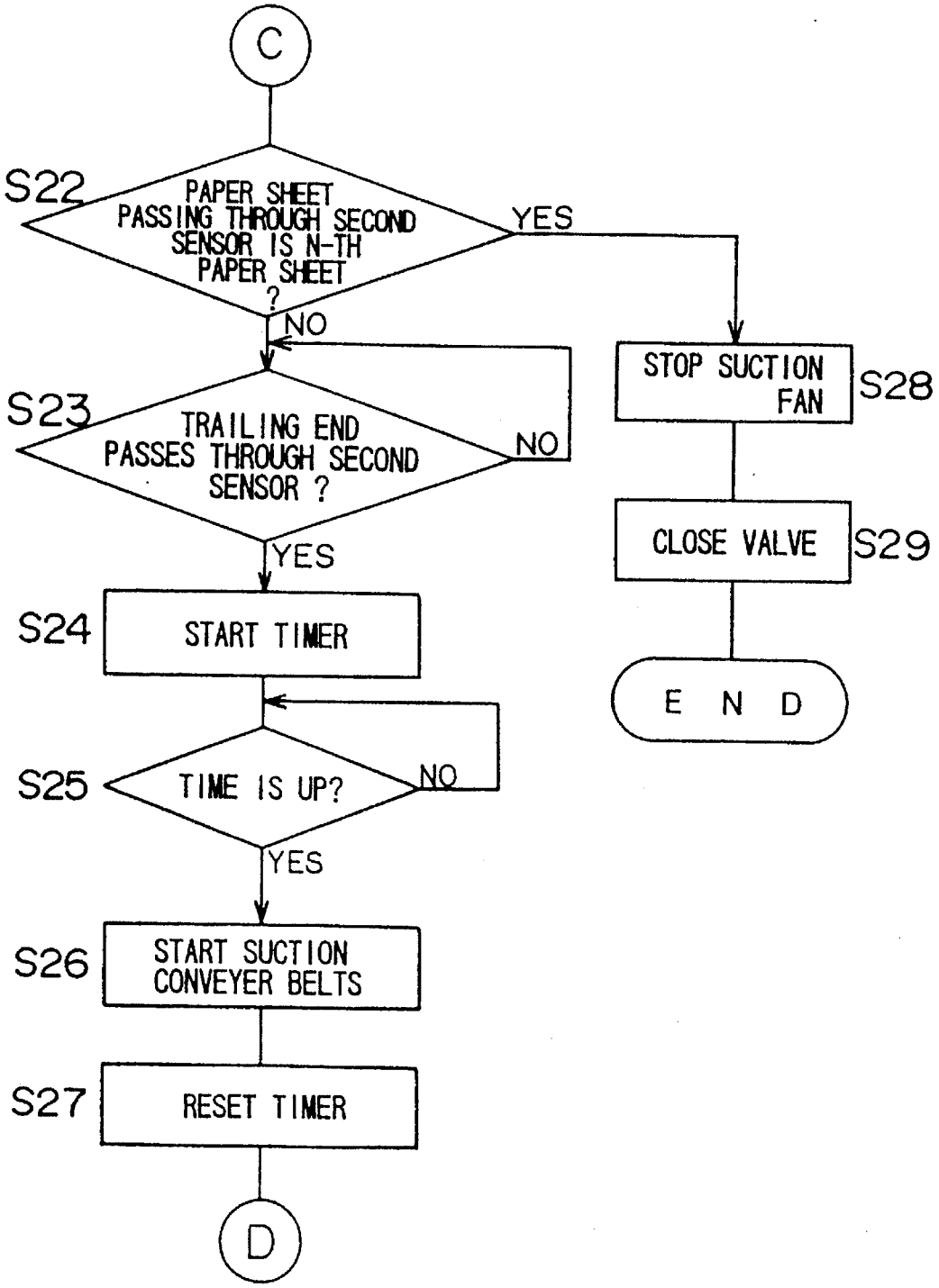
FIG. 11 is a flow chart showing the flow of control subsequently to the flow chart of FIG. 10.
Figure 12:
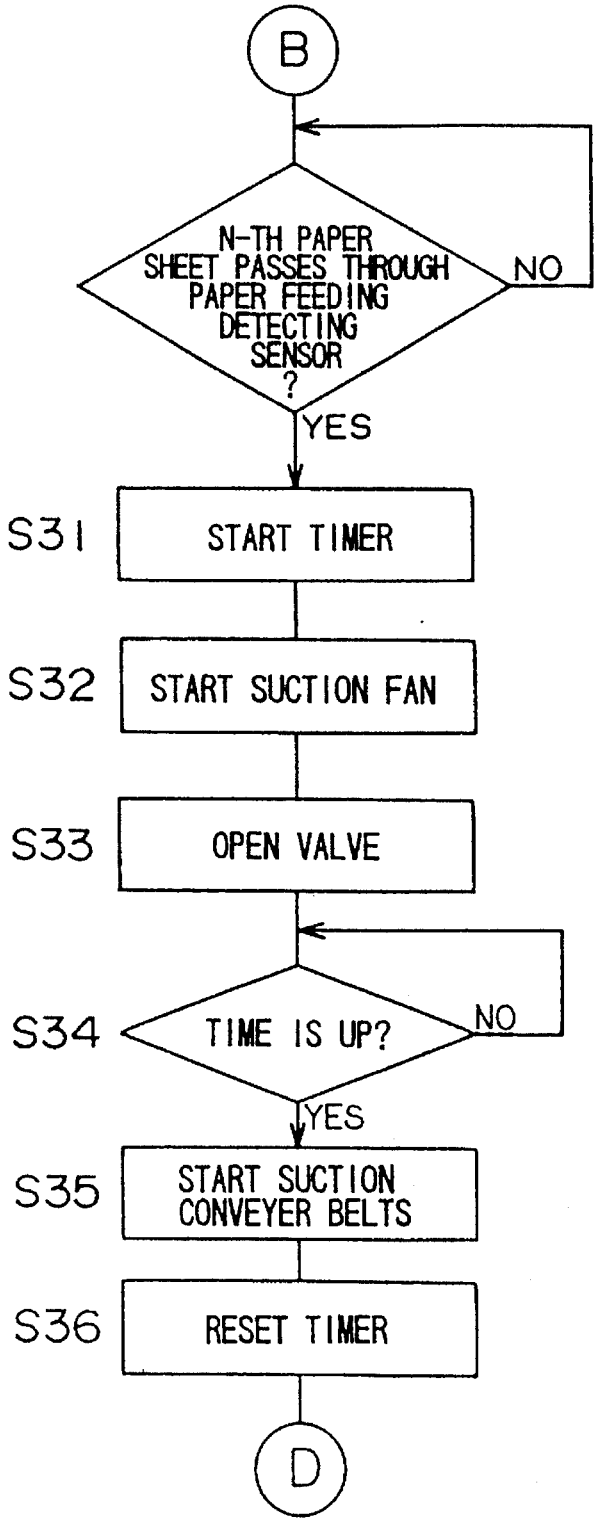
FIG. 12 is a flow chart mainly showing an operation for refeeding the first paper sheet in a case where copies whose number is more than a predetermined number are made with respect to one original.

FIG. 8 is a block diagram showing a control system of the image forming apparatus according to the present invention. The control system comprises a control section 91 for controlling the operation of the main body of the image forming apparatus and an RADF control section 92 for controlling the operation of the reversing automatic document feeder 10. The control section 91 supervises the operations of the respective sections by linking the operation of the reversing automatic document feeder 10 with the operation of the main body of the image forming apparatus. Each of the control sections 91 and 92 comprises a CPU, a ROM storing programs executed by the CPU, a RAM used as a work area, for example, of the CPU, and the like.

An operating section 1 provided on a suitable place of an upper surface of the image forming apparatus, an original size detecting sensor 2 for detecting the original size from the positions where the paper trailing end linear 111 and the paper side end liners 112 and 113 slide, and an original passage detecting sensor 830 are connected to the RADF control section 92. Signals from the operating section 1, an original set detecting sensor 840 for detecting the set of the original on the original platen 11, the original size detecting sensor 2, and the original passage detecting sensor 830 are inputted to the RADF control section 92. Further, a suction fan driving circuit 921 for driving the suction fan 128, a conveyer belt driving circuit 922 for driving the suction conveyer belts 121 to 124, and a delivery roller group driving circuit 923 for driving the groups of delivery rollers 14 to 16 and 18 are connected to the RADF control section 92. The RADF control section 92 controls the operations of the suction fan 128, the suction conveyer belts 121 to 124 and the groups of delivery rollers 14 to 16 and 18.

The operating section 1 comprises various types of key switches such as a start key 1*a* for instructing the start of a copying operation, an original number instructing key 1*b* for instructing the number of originals, a copy number instructing key 1*c* for instructing the number of copies, a paper size instructing key 1*d* for instructing the paper size, and a copy mode instructing key 1*e* for instructing a copy mode such as single copying or duplex copying, and comprises a display section If for displaying the contents of the operations of the key switches, for example.

The original size detecting sensor 2 is constituted by a potentiometer which has a sliding contact sliding in synchronism with the paper trailing end linear 111 (the paper side end linear 112 or 113) and whose resistance value is changed depending on the position of the sliding contact, a photosensor for optically detecting the position of the paper trailing end linear 111 (the paper side end linear 112 or 113), and the like which are provided in each of the paper trailing end linear 111 and the paper side end liners 112 and 113. The original set detecting sensor 840 is constituted by a photosensor and the like.

The paper feeding detecting sensor 80, the first paper passage detecting sensor 81, the second paper passage detecting sensor 82 and the operating section 1 as described above are connected to the control section 91. Signals from the respective sensors 80 to 82 and the operating section 1 are inputted to the control section 91. Further, a suction fan driving circuit 911 for driving the suction fan 528, a valve driving circuit 912 for driving the valve 83, a conveyer belt driving circuit 913 for driving the suction conveyer belts 521 to 524, and a delivery roller group driving circuit 914 for driving the groups of delivery rollers 45 to 49 and 54 to 56 are connected to the control section 91. The control section 91 controls the operations of the suction fans 528, the valve 83, the suction conveyer belts 521 to 524, and the groups of delivery rollers 45 to 49 and 54 to 56.

Figure 16:
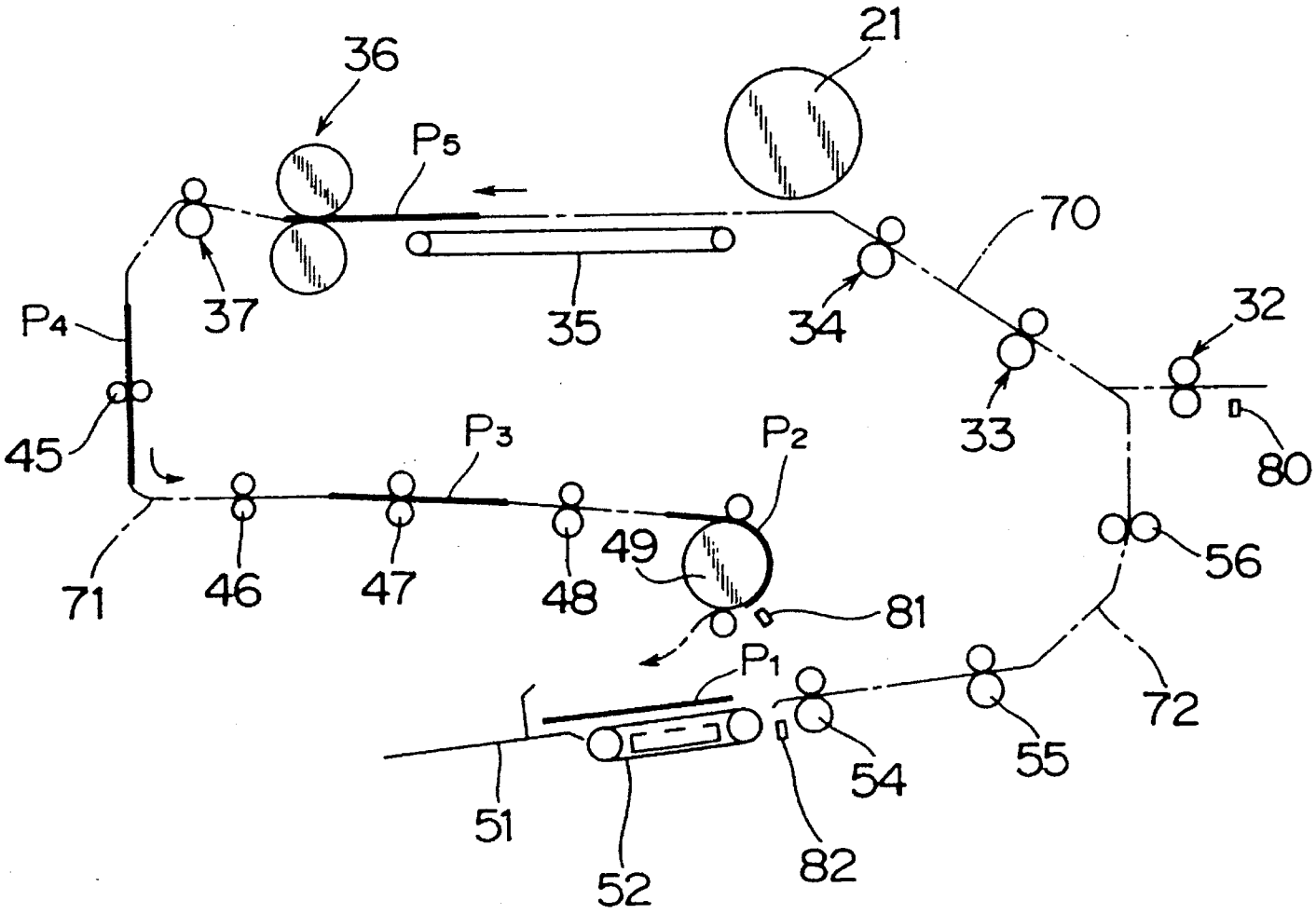
FIG. 16 is a schematic view showing a paper feeding path in a case where copies whose number is less than a predetermined number are made with respect to one original, which illustrates a state where the first paper sheet has been stacked.
Figure 17:
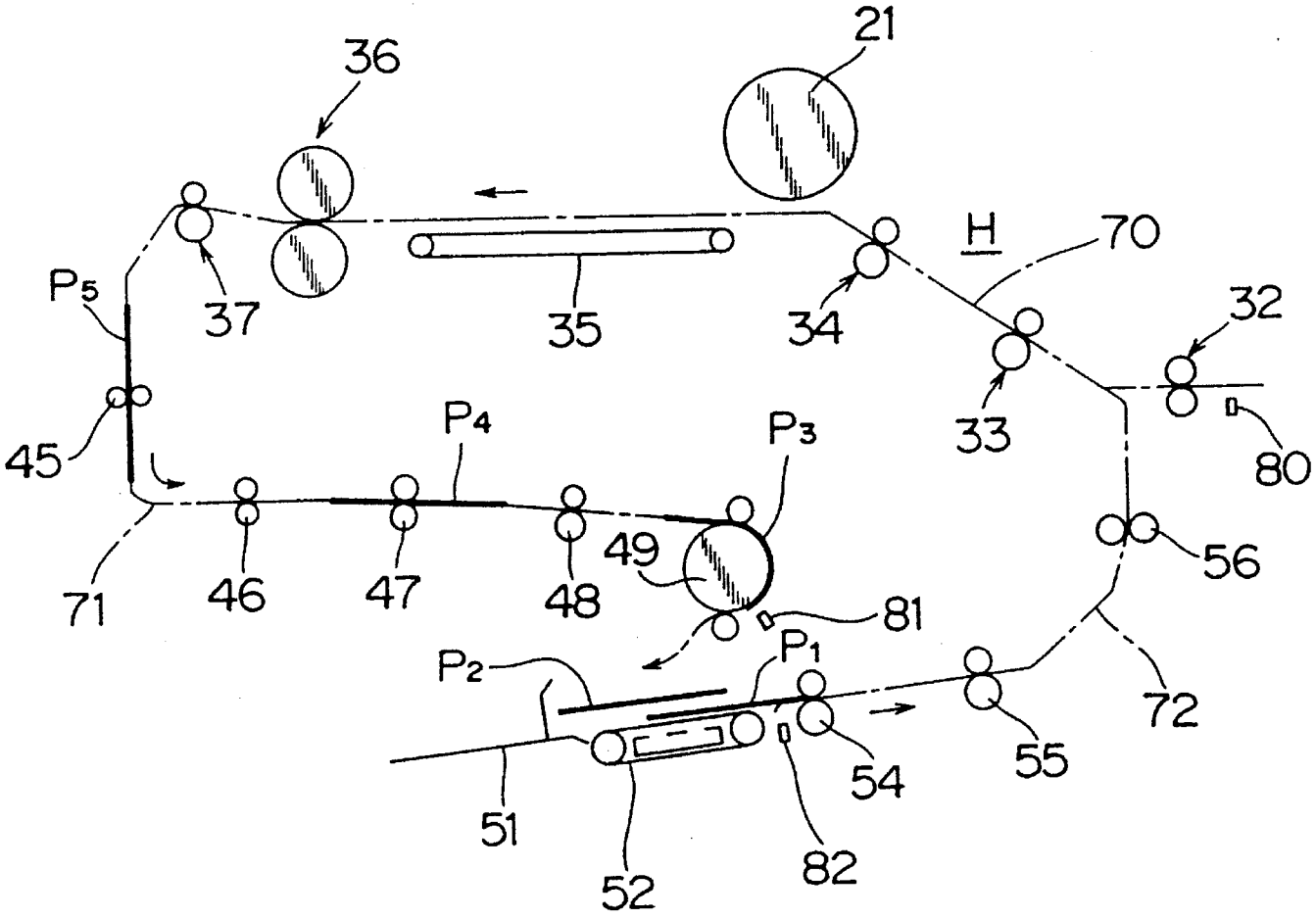
FIG. 17 is a schematic view showing a paper feeding path in a case where copies whose number is less than a predetermined number are made with respect to one original, which illustrates a state where the suction and conveyance of the first paper sheet is started.
Figure 18:
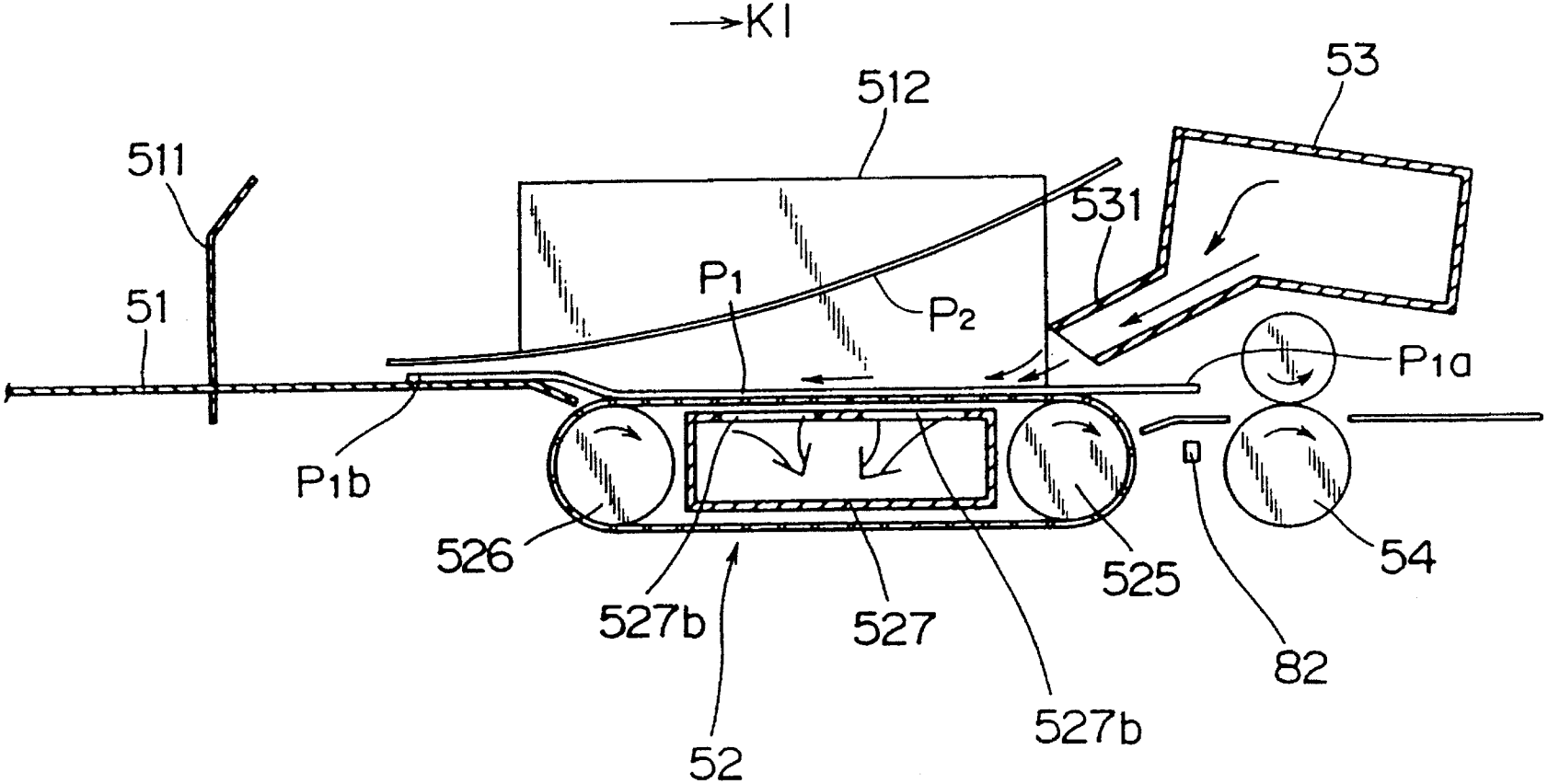
FIG. 18 is a schematic sectional view showing a principal part of the paper refeeding device, which illustrates a state immediately after starting the suction and conveyance of the first paper sheet.
Figure 19:
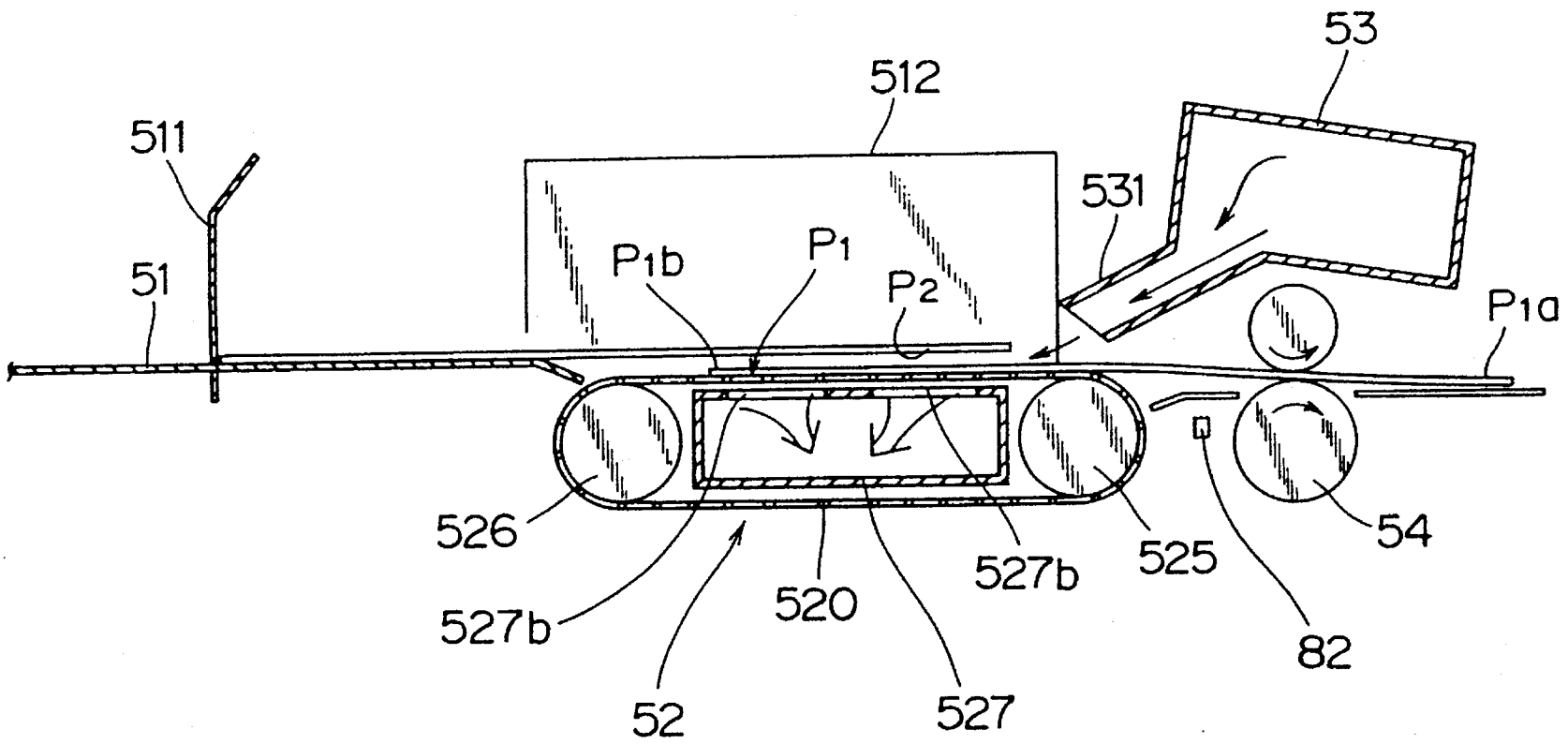
FIG. 19 is a schematic sectional view showing a principal part of the paper refeeding device, which illustrates a state where the suction conveyer belt is stopped.
Figure 20:
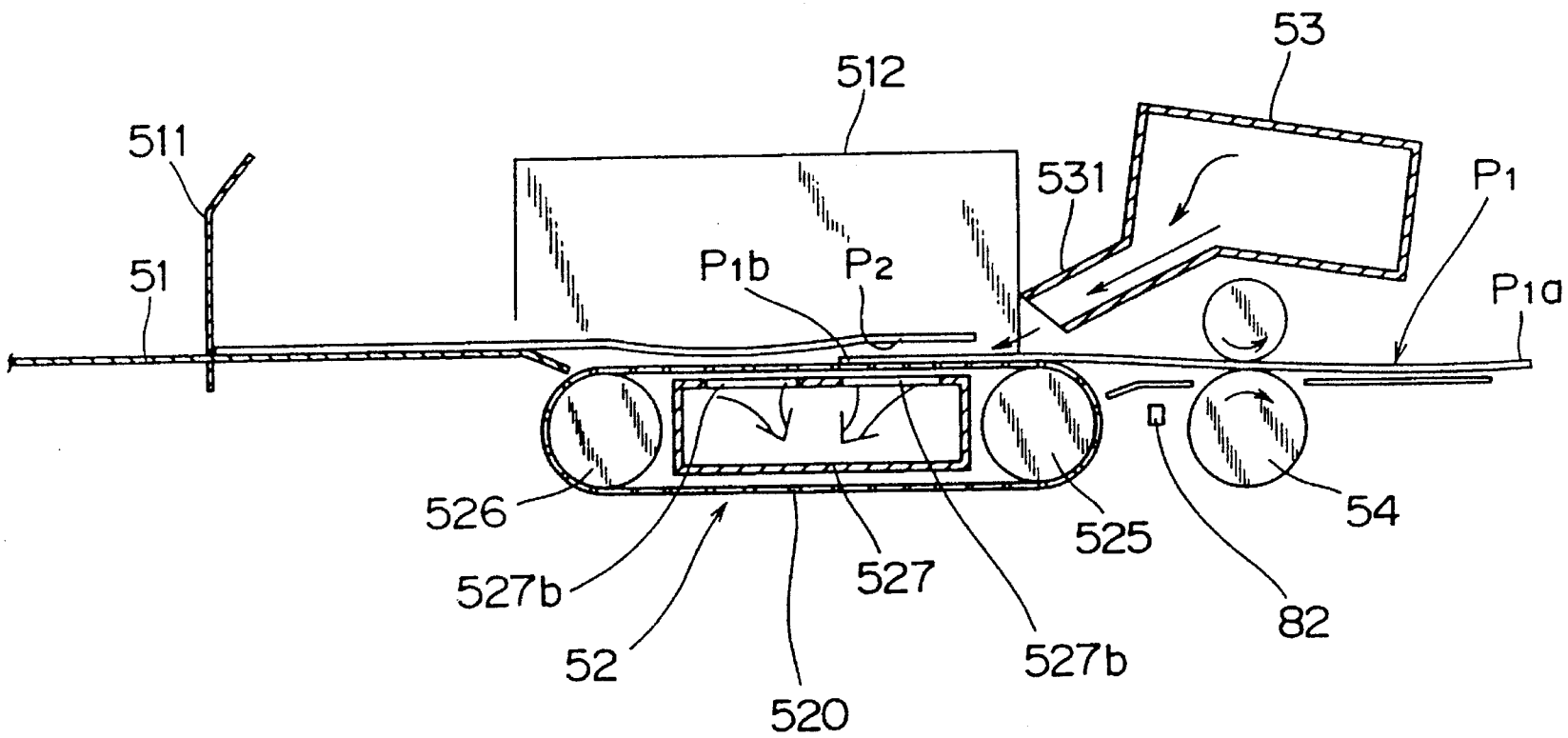
FIG. 20 is a schematic sectional view showing a principal part of the paper refeeding device, which illustrates a state where the trailing end of the first paper sheet opens an air suction port of the suction duct.
Figure 21:
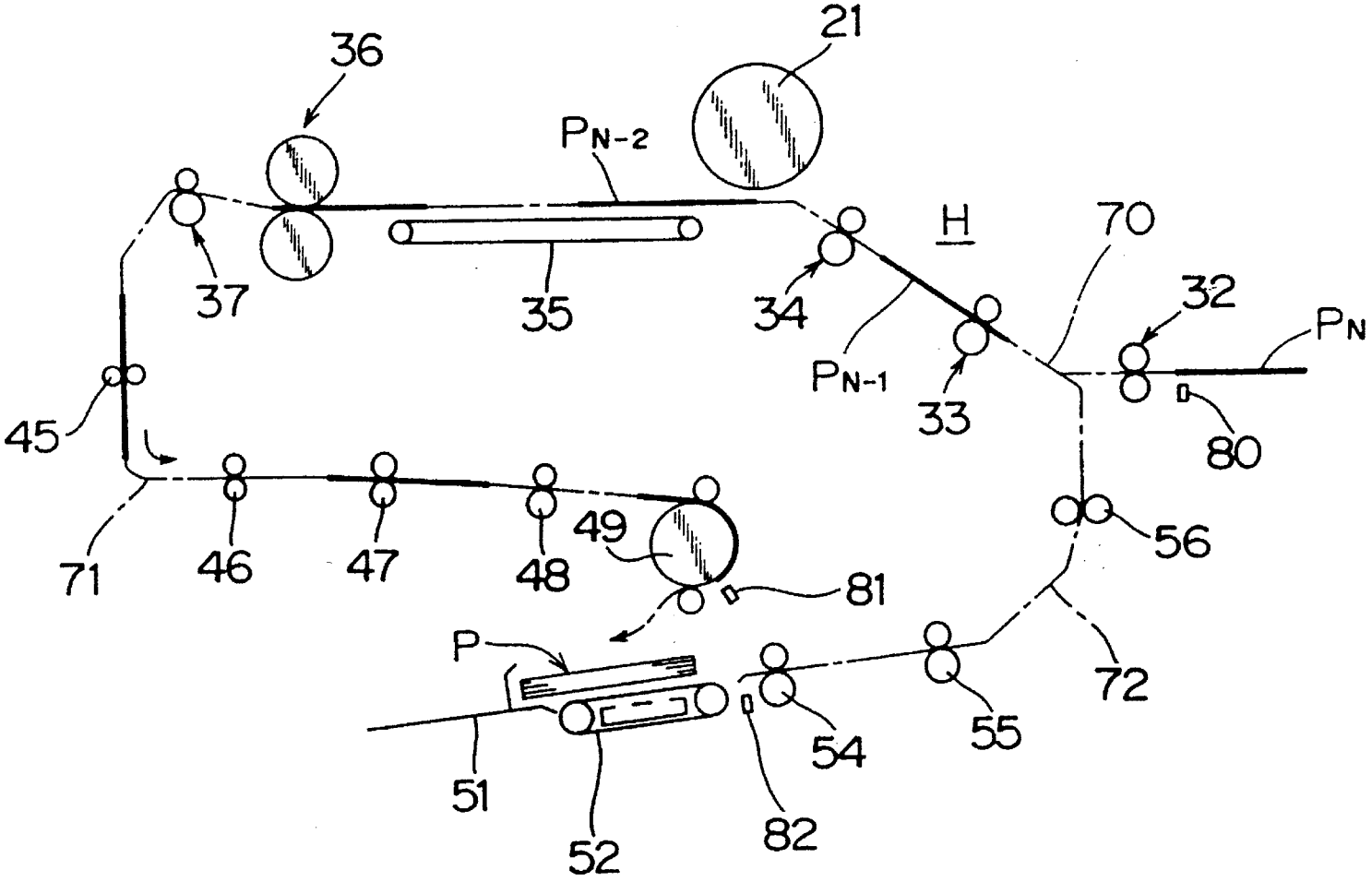
FIG. 21 is a schematic view showing a paper feeding path in a case where copies whose number is more than a predetermined number are made with respect to one original, which illustrates a state where the final paper sheet reaches a paper feeding detecting sensor.
Figure 22:
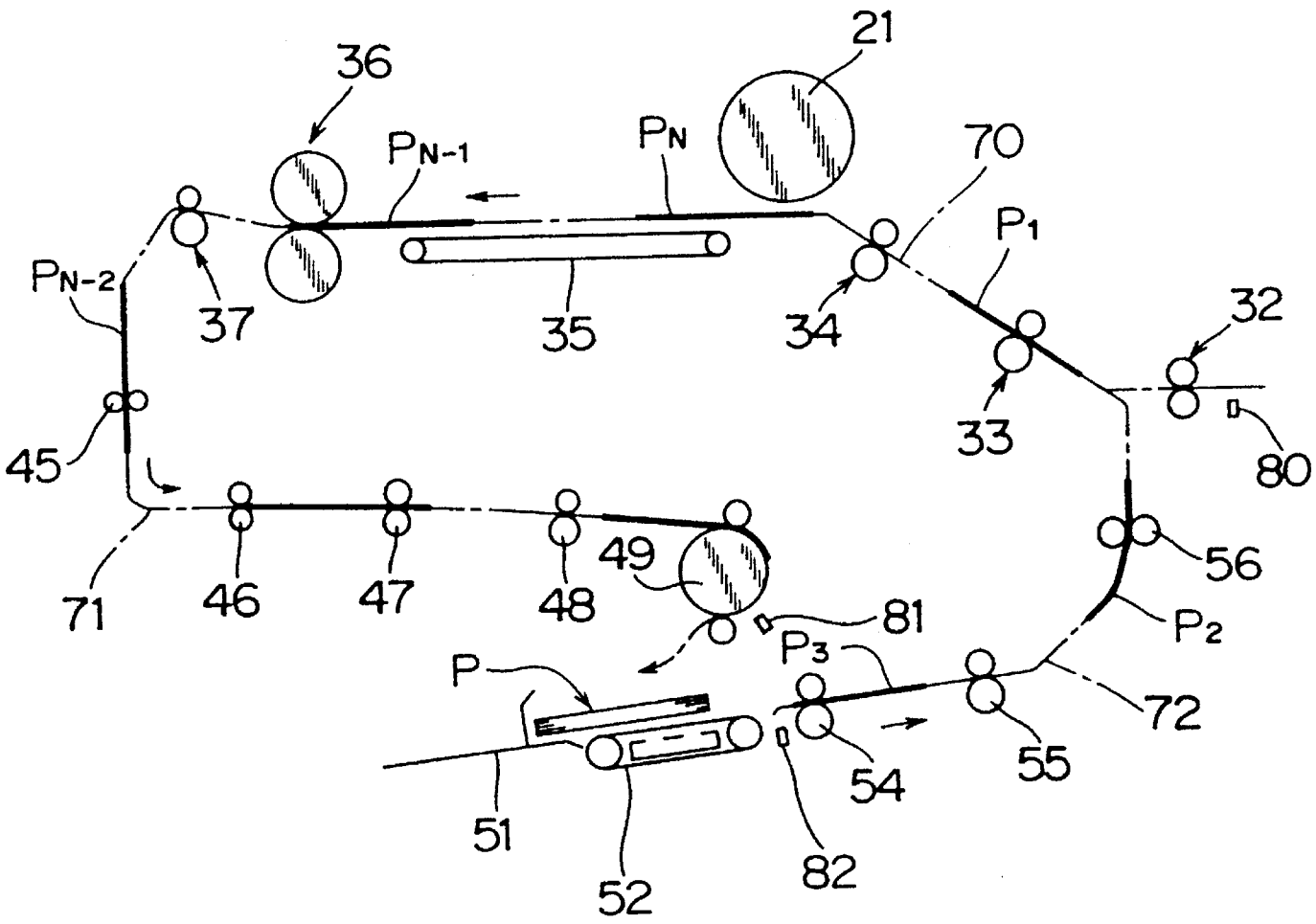
FIG. 22 is a schematic view showing the paper feeding path in a case where copies whose number is more than a predetermined number are made with respect to one original, which illustrates a state where a paper sheet fed again is fed to a photosensitive drum subsequently to the final paper sheet.

The operation of the paper feeding device 50 by the control section 91 will be described using FIGS. 9 to 12 which are flow charts, FIG. 13 which is a timing chart, FIGS. 14 and 15 showing an operation in the suction duct 528, FIGS. 16 and 17 which are schematic views of a paper feeding path showing an operation in a case where copies whose number is smaller than a predetermined number are made with respect to one original, FIGS. 18 to 20 showing an operation for suction and conveyance in a case where copies whose number is smaller than the predetermined number are made with respect to one original, and FIGS. 21 and 22 which are schematic views of a paper feeding path showing an operation for feeding the first paper sheet again in a case where copies whose number is larger than the predetermined number are made with respect to one original.

If a worker first sets the number of copies N, the paper size, and the copy mode (duplex copying or the like) by the copy number instructing key 1*c*, the paper size instructing key 1*d* and the copy mode instructing key 1*e* in the operating section 1 (step S1), and then turns the copy start key 1*a* on, a copying operation is started (steps S2 and S3). Specifically, a plurality of paper sheets are successively sent out at predetermined spacing (for example, approximately 100 mm to 180 mm) from the paper feeding section 29 containing paper sheets of the set size, and are sent out to the image forming section R through the primary paper feeding path 70.

If the number of copies N set by the copy number instructing key 1*c* (the number of copies made with respect to one original) is not more than a previously set number $N_p$ (the number of paper sheets which can exist in the paper feeding path and the number of paper sheets determined on the basis of the paper size set by the paper size instructing key 1*d*, for example, ten), control in the steps S5 to S28 is carried out. On the other hand, if the number of copies N exceeds the above described number $N_p$, control in the step S29 and the subsequent steps are carried out.

If copies whose number N is smaller than the predetermined number $N_p$ (for example, five) are made with respect to one original, the suction fan 528 is started and the valve 83 is closed as the copying is started (step S5). The paper refeeding device 50 waits until the leading end of the first paper sheet $P_1$ having a toner image transferred on its one side through the image forming section R reaches the first paper passage detecting sensor (hereinafter referred to as first sensor) 81 through the stacking and conveying path 71, as shown in FIG. 16 (step S6). After the reach, the valve is opened and a timer is reset after an elapse of a predetermined time period (steps S7 to S10).

Figure 13:
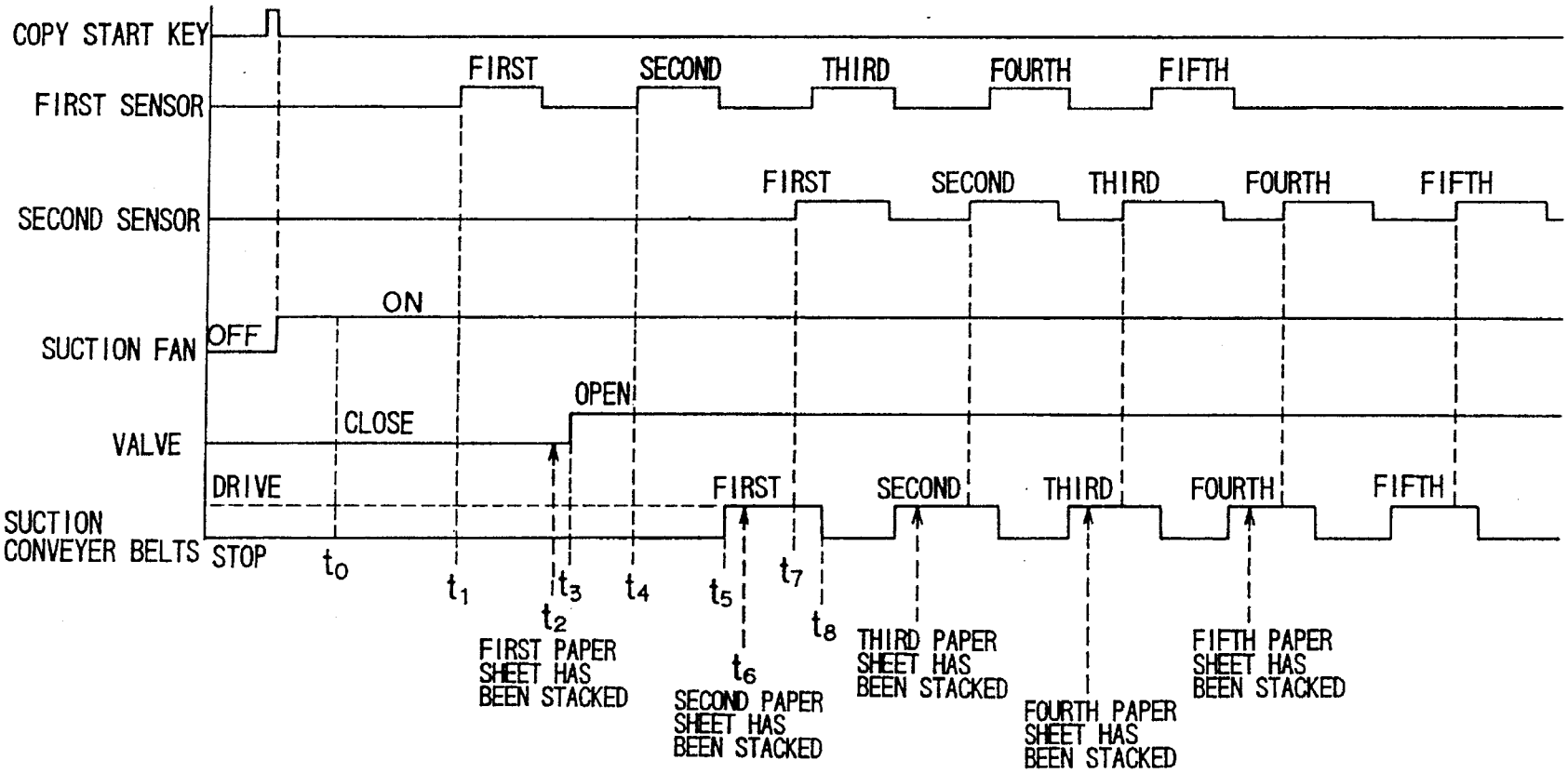
FIG. 13 is a timing chart showing a case where copies whose number is less than a predetermined number are made with respect to one original.

Referring to FIG. 13, timing $t_3$ at which the valve 83 is opened is determined in the following manner. Specifically, timing $t_2$ at which the first paper sheet $P_1$ is stacked on the sheet table 51 is found from timing $t_1$ at which the leading end of the first paper sheet $P_1$ passes through the first sensor 81 and the paper size set by the operating section 1, and the above described timing $t_3$ is set to predetermined timing after an elapse of a predetermined time period from the timing $t_2$. Consequently, a value which differs depending on the paper size is set as time set by the timer (a time period from the timing $t_1$ to the timing $t_3$).

Since the amount of sucked air is restricted by the valve 83 until the predetermined timing $t_2$ after stacking the first paper sheet $P_1$, the first paper sheet $P_1$ is not prevented from being stacked by the suction. Consequently, it is possible to reliably stack the first paper sheet $P_1$ in the regular position. Since the amount of sucked air is increased by the valve 83 at the predetermined timing $t_3$ after stacking the first paper sheet $P_1$, it is possible to suck and convey the paper sheet first stacked, that is, the lowermost paper sheet $P_1$ without adversely affecting the stack of the second and the subsequent paper sheets P. Moreover, at a time point where the opening of the valve 83 is switched, the suction fan 528 has already reached its predetermined suction capability, thereby to make it possible to eliminate loss time caused by the delay of the suction fan 528.

Furthermore, the valve 83 is opened in a state where the first paper sheet $P_1$ has been stacked so that the small holes 520 of the suction conveyer belts 521 to 524 are closed by the first paper sheet $P_1$. Accordingly, it is possible to prevent the occurrence of the problem that the second paper sheet $P_2$ and the subsequent paper sheets cannot be stacked in the regular position under the adverse effect of the suction of air.

In the step S11, the passage of the leading end of the second paper sheet $P_2$ through the first sensor 81 is then waited for. If the leading end of the second paper sheet $P_2$ passes through the first sensor 81, the driving of the suction conveyer belts 521 to 524 is started at predetermined timing $t_5$ after an elapse of a predetermined time period from timing of the passage $t_4$, as shown in FIG. 13, after which the timer is reset (steps S12 to S15). If the leading end $P_1a$ of the lowermost paper sheet $P_1$ conveyed by the suction conveyer belts 521 to 524 reaches the second paper passage detecting sensor (hereinafter referred to as second sensor) 82, as shown in FIG. 18 (step S6, timing $t_7$ in FIG. 13), the suction conveyer belts 521 to 524 are stopped (step S19, timing $t_8$ in FIG. 13) after an elapse of a predetermined time period (steps S17 to S18), after which the timer is reset (step S20).

Figure 15A:
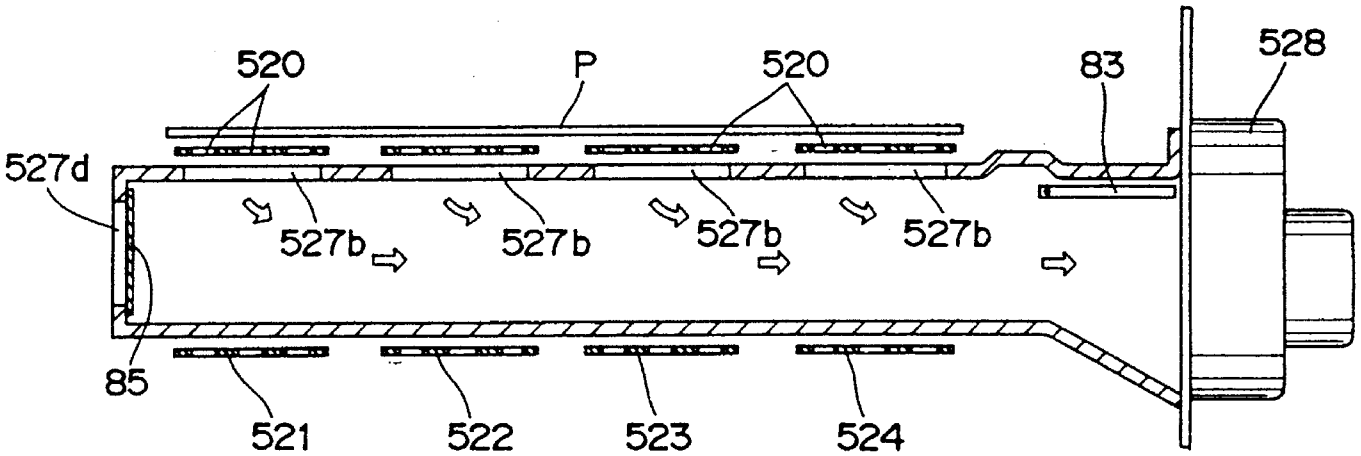
FIGS. 15A and FIG. 15B are cross sectional views showing the suction duct, where
Figure 15B:
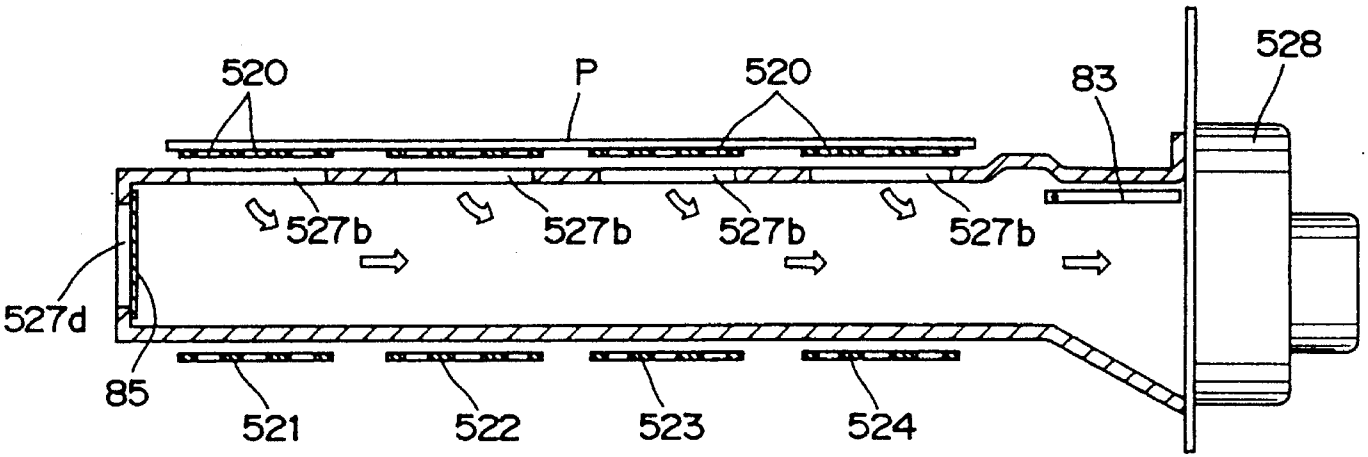

Referring to FIGS. 14A, 14B, 15A, 15B and FIG. 1, the operation in the suction duct 527 will be described with the passage of time. FIG. 14A illustrates the suction duct 527 in a state of timing $t_0$ after starting the suction fan 528 and before the above described timing $t_1$ in FIG. 13. FIG. 14B illustrates the suction duct 527 in a state of the timing $t_2$ in FIG. 13 at which the first paper sheet $P_1$ has been stacked. FIG. 15A illustrates the suction duct 527 in a state of the timing $t_3$ in FIG. 13 at which the valve 83 is opened in the step S9. FIG. 15B illustrates a state immediately after the timing $t_3$ where the first paper sheet $P_1$ has been just adsorbed on the suction conveyer belts 521 to 524. Immediately after the adsorption, the lamina 85 opens the auxiliary suction port **527*d* and air is sucked through the auxiliary suction port 527*d*, as shown in FIG. 1. As a result, it is possible to ensure a sufficient amount of air supplied to the air nozzle 53 even in a state where the air suction port 527*b*** is closed.

Consequently, it is possible to reliably separate the lowermost paper sheet $P_1$ and the upper paper sheets P from each other. Specifically, air sucked by the suction fan 528 through the suction duct 527 is introduced into the air nozzle 53 through the guide duct 529, and the air is blown on the leading end of the lowermost paper sheet $P_1$ from the air nozzle 53. In the present embodiment, the auxiliary suction port **527*d* is provided. Even if the small holes 520 of the suction conveyer belts 521 to 524 are closed by the paper sheet P adsorbed on the suction conveyer belts 521 to 524, the air is sucked into the suction duct 527 through the auxiliary suction port 527*d*. As a result, it is possible to reliably ensure the amount of air blown off from the air nozzle 53, as described above. Consequently, it is possible to separate the lowermost paper sheet $P_1$ from the upper paper sheets P. Specifically, the amount of air blown off from the air nozzle 53 for separating the paper sheets is ensured while simplifying the construction of the sheet refeeding device 50 by sharing the suction fan 528**, thereby to make it possible to reliably prevent the paper sheets from being fed by being overlapped with each other.

Moreover, the above described auxiliary suction port **527*d* is disposed on the upstream side of the air suction ports 527*b* of the suction duct 527 in the direction of suction, thereby to make it possible to ensure a sufficient amount of sucked air through the air suction ports 527*b* and the small holes 520 of the suction conveyer belts 521 to 524 and reliably suck the paper sheets P by the suction conveyer belts 521 to 524**. Consequently, it is possible to reliably convey the paper sheets.

Furthermore, the lamina 85 serving as a valve is provided in the auxiliary suction port **527*d*, thereby to produce the following function and effect. Specifically, immediately after the suction of air is started, the lamina 85 serving as a valve reduces the opening of the auxiliary suction port 527*d*. Accordingly, the paper sheets P are sucked mainly through the small holes 520, and are adsorbed on the suction conveyer belts 521 to 524. After the small holes 520 are closed by the adsorbed paper sheet P, atmospheric pressure in the suction duct 527 is reduced, thereby to increase a pressure differential across the auxiliary suction port 527*d*. Correspondingly, the lamina 84 enlarges the opening of the auxiliary suction port 527*d*, and air is sucked through the auxiliary suction port 527*d* whose opening is enlarged. As a result, it is possible to ensure the amount of air supplied to the air nozzle 53 through the guide duct 529. Sufficient suction and sufficient blow-off of air can be thus compatible with each other. Particularly, the lamina 85 composed of a thin plate member having elasticity which is, for example, "LUMILAR" made by "TORAY CO., LTD." is employed as a valve, thereby to make it possible to adjust the opening of the auxiliary suction port 527*d*** depending on the pressure differential. Further, it is possible to reduce the manufacturing cost.

The timing $t_5$ at which the suction conveyer belts 521 to 524 are started is determined in the following manner. Specifically, timing $t_6$ at which the second paper sheet $P_2$ has been stacked on the sheet table 51 is found from the timing $t_4$ at which the leading end of the second paper sheet $P_2$ passes through the first sensor 81 and the paper size set by the paper size instructing key **1*d***, and is set to the above described timing $t_5$ a predetermined time period before the timing $t_6$.

Referring now to FIGS. 17 to 20, description is now further made of the setting of the timing $t_5$ at which the suction conveyer belts 521 to 524 are started. If copies whose number N is smaller than a predetermined number $N_p$ are made with respect to one original, the suction conveyer belts 521 to 524 may be started to start paper refeeding immediately after the first paper sheet $P_1$ has been stacked. In such a case, it is necessary to close the valve 83 once in order that the suction of air does not prevent the second paper sheet $P_2$ from being stacked, while opening the valve 83 again when the paper sheet P is conveyed by the suction conveyer belts 521 to 524. However, the paper refeeding device 50 cannot cope with high-speed copying if the valve 83 is opened and closed every time the paper sheet P is stacked. Therefore, the subsequent paper sheet $P_2$ is stacked in a state where the small holes 520 of the suction conveyer belts 521 to 524 are always closed by one paper sheet $P_1$. In this case, the suction conveyer belts 521 to 524 may be started after the second paper sheet $P_2$ has been stacked. In the present embodiment, however, the timing $t_5$ at which the suction conveyer belts 521 to 524 are started is so set that the second paper sheet $P_2$ has been stacked immediately before the air suction ports **527*b* of the suction duct 527** are opened by the lowermost paper sheet $P_1$.

When the conveyance of the first paper sheet $P_1$ is started as shown in FIG. 18, the second paper sheet $P_2$ has not been stacked yet. When the second paper sheet $P_2$ has been stacked as shown in FIG. 19, the trailing end $P_1b$ of the first paper sheet $P_1$ is in a state immediately before a part of the air suction port 527*b* on the upstream side of the suction duct 527 is opened. That is, in FIG. 19, the trailing end $P_1b$ of the paper sheet $P_1$ is positioned on the upstream side of the air suction port 527*b* on the upstream side in the direction of conveyance K1.

On the other hand, the timing $t_8$ at which the suction conveyer belts 521 to 524 are stopped is determined in the following manner. Specifically, timing at which the trailing end $P_1b$ of the first paper sheet $P_1$ reaches the air suction port 527*b* is found on the basis of the timing $t_7$ at which the leading end $P_1a$ of the paper sheet $P_1$ reaches the second sensor 82 and the paper size set by the operating section 1, and the above described timing $t_8$ is set to timing a predetermined time period before the found timing. The timing $t_8$ is so set as to be timing at which the leading end $P_1a$ of the paper sheet $P_1$ has already reached the pair of delivery rollers 54. Before the trailing end $P_1b$ of the paper sheet $P_1$ reaches the air suction port 527*b* to open the air suction port 527*b*, the suction conveyer belts 521 to 524 are stopped, whereby the second paper sheet $P_2$ is prevented from being unnecessarily conveyed by the suction conveyer belts 521 to 524. As a result, it is possible to reliably stack the paper sheet $P_2$ in the regular position. Further, the above described timing $t_8$ is found in consideration of the paper size. When a long paper sheet of A3 size, for example, is conveyed by the delivery rollers 45, the paper sheet can be prevented from being rubbed against the suction conveyer belts 521 to 524 for an unnecessarily long time period.

Furthermore, even after the suction conveyer belts 521 to 524 are stopped at the above described timing $t_8$, the suction fan 528 continues to suck the paper sheets. After the trailing end $P_1$ of the lowermost paper sheet $P_1$ opens a part of the air suction port 527*b*, therefore, the second paper sheet $P_2$ is sucked by the stopped suction conveyer belts 521 to 524 through the opened air suction port 527*b*, as shown in FIG. 20. Consequently, the second paper sheet $P_2$, along with the lowermost paper sheet $P_1$, is prevented from being shifted in position toward the downstream side. If the position of the second paper sheet $P_2$ is shifted, the leading end of the second paper sheet $P_2$ is reliably shifted from the position where air is blown off by the air nozzle 53, whereby the second paper sheet $P_2$ cannot be raised. As a result, there is a possibility that the paper sheets are fed while being overlapped with each other. In the present embodiment, therefore, such a possibility is eliminated.

The positional relationship between the pair of delivery rollers 54 and the air suction port 527*b* on the upstream side is so set that the trailing end $P_1b$ of the paper sheet $P_1$ of the minimum size is positioned on the upstream side of the air suction port 527*b* on the upstream side in the direction of conveyance K1 at timing at which the leading end $P_1a$ of the paper sheet $P_1$ of the minimum size reaches the pair of delivery rollers 54. The timing $t_8$ at which the suction conveyer belts 521 to 524 are stopped is set to a predetermined timing after the timing at which the leading end $P_1a$ of the paper sheet $P_1$ of the minimum size reaches the pair of delivery rollers 54 and before the timing at which the trailing end $P_1b$ of the paper sheet $P_1$ of the minimum size opens a part of the air suction port 527*b*. Consequently, the paper sheet of the minimum size opens a part of the air suction port 527*b* after the paper sheets of the minimum size have been conveyed by the pair of delivery rollers 54. Therefore, it is possible to prevent the paper sheets of the minimum size from being fed while being overlapped with each other.

In the step S21, the paper sheets P are successively sucked and conveyed one at a time by repeating the operations in the steps S11 to S20 until the paper sheet P passing through the second sensor 82 is the second paper sheet from the final paper sheet (that is, the (N−1)-th paper sheet, the fourth paper sheet in the present embodiment).

If the suction conveyer belts 521 to 524 for conveying the (N−1)-th (fourth) paper sheet P are stopped (step S19), after which the trailing end of the (N−1)-th (fourth) paper sheet P passes through the second sensor 82 (step S23), the elapse of a predetermined time period from timing of the passage $t_9$ is waited for (steps S24 to S25), the suction conveyer belts 521 to 524 are started at timing $t_{10}$ after an elapse of a predetermined time period from the timing of the passage $t_9$ (step S26), and the suction and conveyance of the N-th (fifth) paper sheet which is the final paper sheet is started and the timer is reset (step S27).

Thereafter, if the leading end of the N-th (fifth) paper sheet P passes through the second sensor 82 (step S16), the suction conveyer belts 521 to 524 are stopped at timing $t_{12}$ after an elapse of a predetermined time period from timing of the passage $t_{11}$ (step S19), after which the suction fan is stopped and the valve 83 is closed (steps S28 and S29), to terminate the processing.

As described in the foregoing, if the set number of copies N is not more than a predetermined number, it is possible to feed the paper sheets P again very efficiently by only stacking the minimum number of paper sheets P on the sheet table 51. Consequently, the paper refeeding device 50 can cope with high-speed copying of the image forming apparatus.

Particularly, the second paper sheet $P_2$ from the lowermost paper sheet is stacked in a state where the small holes 520 of the suction conveyer belts 521 to 524 are always closed by the lowermost paper sheet $P_1$, thereby to make it possible to reliably stack the second paper sheet $P_2$ in the regular position. Moreover, the conveyance of the lowermost paper sheet $P_1$ is started immediately before the second paper sheet $P_2$ has been stacked, thereby to make it possible to feed the paper sheets again at significantly high efficiency and at high speed.

Since the lowermost paper sheet $P_1$ is so sucked and conveyed that a part of the air suction port 527*b* can be opened by the lowermost paper sheet $P_1$ immediately after the second paper sheet $P_2$ has been stacked, the second paper sheet $P_2$ is stacked without being affected by the suction. As a result, it is possible to reliably stack the paper sheets P in the regular position. Particularly, in a sheet conveying device of such a type that the paper sheets P cross the suction conveyer belts 521 to 524 so as to be dropped obliquely downward in the air above the suction conveyer belts 521 to 524, the removal of the effect of the suction produces an effect in stacking the paper sheets P in the regular position.

Furthermore, if the mechanical valve 83 is opened and closed for each paper sheet at the time of stacking the paper sheets P on the sheet table 51 and the time of conveying the paper sheets P from the sheet table 51, the valve 83 cannot be opened and closed at significantly high speed, thereby to make it impossible to make copies at high speed. On the other hand, in the present embodiment, the lowermost paper sheet $P_1$ serves as an opening and closing valve for not preventing the second paper sheet $P_2$ from being stacked, whereby the valve 83 need not be opened and closed as described above each time (may remain opened), which can contribute to high-speed copying.

Additionally, in the present embodiment, air is blown by the air nozzle 53 on the leading end of the lowermost paper sheet $P_1$, to raise the leading end of the second paper sheet $P_2$ and separate the second paper sheet $P_2$ from the lowermost paper sheet $P_1$. If the second paper sheet $P_2$ is not stacked in the regular position, therefore, the second paper sheet $P_2$ cannot be raised. As a result, the second paper sheet $P_2$ cannot be separated from the lowermost paper sheet $P_1$. Therefore, the paper sheets P are fed overlapping each other. On the other hand, in the present embodiment, the second paper sheet $P_2$ is reliably stacked in the regular position as described above, thereby to make it possible to prevent the paper sheets P from being fed while being overlapped with each other.

Furthermore, the timing at which the second paper sheet $p_2$ has been stacked is found on the basis of the timing of the passage of the second paper sheet $P_2$ which is detected by the first sensor 81, thereby to make it possible to find the timing at which the second paper sheet $P_2$ has been stacked. Moreover, the paper size set by the paper size instructing key 1*d* in the operating section 1 is also considered, thereby to prevent the air suction port 527*b* from being unnecessarily opened until the second paper sheet $P_2$ has been stacked. Consequently, it is possible to stack the second paper sheet $P_2$ in the regular position more reliably.

On the other hand, if the number of copies N instructed by the copy number instructing key 1*c* exceeds a previously set number $N_p$ (the number which can exist in the paper feeding path, for example, ten), the passage of the leading end of the N-th paper sheet P which is the final paper sheet through the paper feeding detecting sensor 80 is waited for (steps S4 and S30). If the leading end of the N-th paper sheet P passes through the paper feeding detecting sensor 80 as shown in FIG. 21, the suction fan 528 is started and the valve 83 is opened (steps S32 and S33), the suction conveyer belts 521 to 524 are started after an elapse of a predetermined time period from timing of the passage, and the refeeding of the first paper sheet $P_1$ is started, after which the timer is reset (step S36). Subsequently, the paper sheets P are successively fed again one at a time by the operations in the steps S11 to S29. The timing at which the suction conveyer belts 521 to 524 are started is set to timing at which the final paper sheet PN can be followed by the first paper sheet $P_1$ which is fed again to reach the primary paper feeding path 70 at predetermined spacing, as shown in FIG. 22. Consequently, it is possible to eliminate unnecessary loss time.

Figure 23:
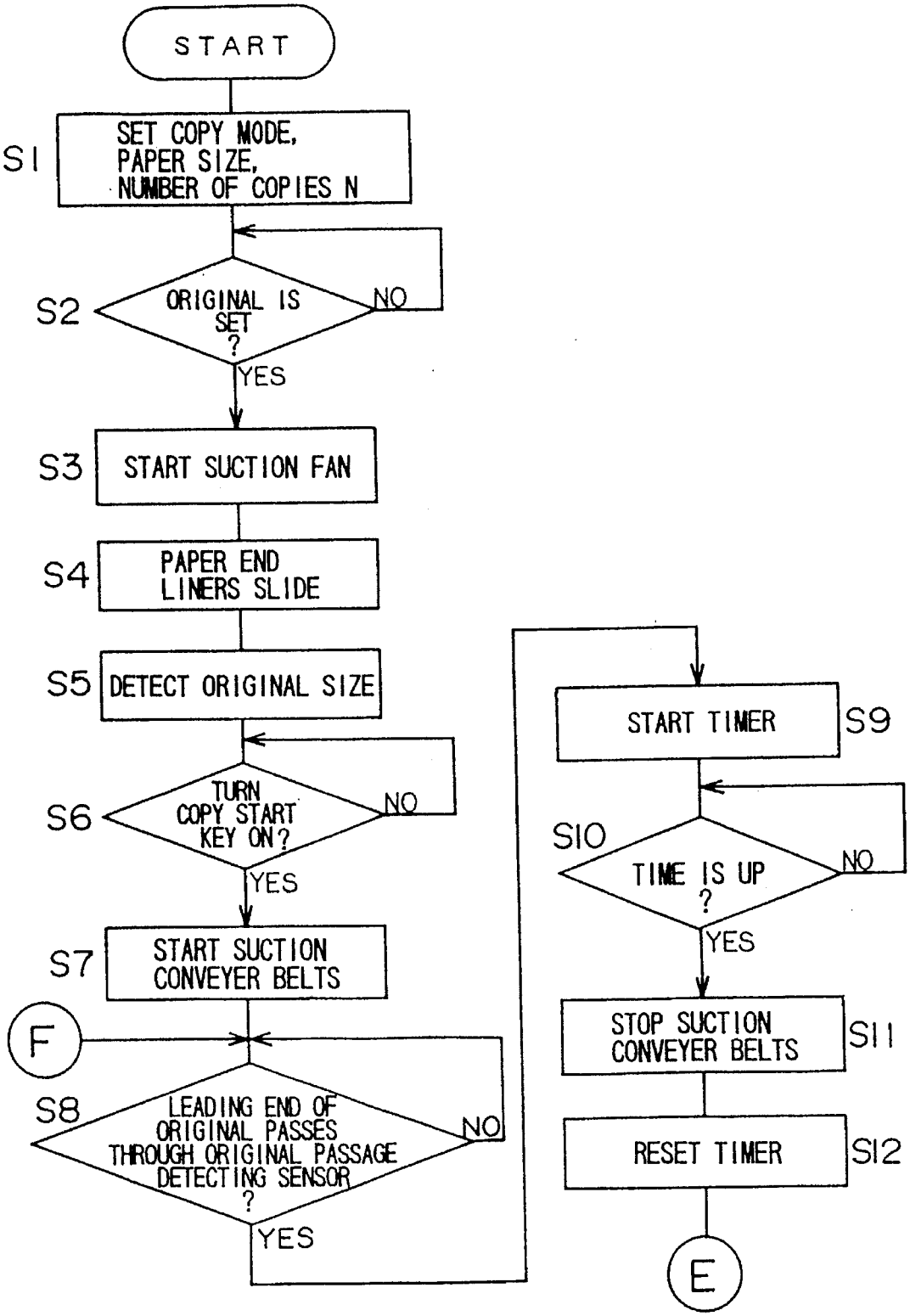
FIG. 23 is a flow chart showing the flow of control of an original feeding operation by an automatic document feeder according to another embodiment of the present invention.
Figure 24:
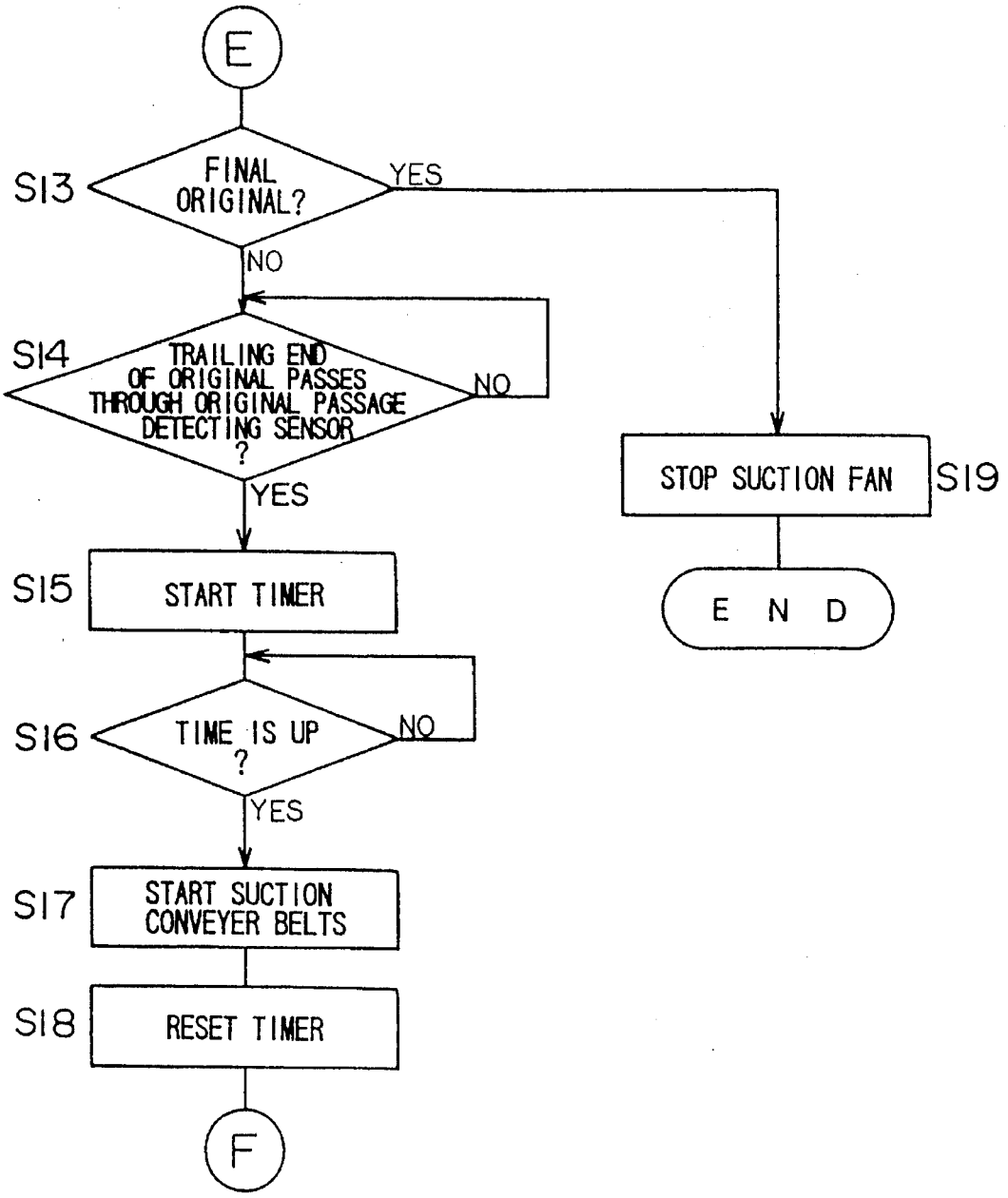
FIG. 24 is a flow chart subsequent to the flow chart of FIG. 23.
Figure 25:
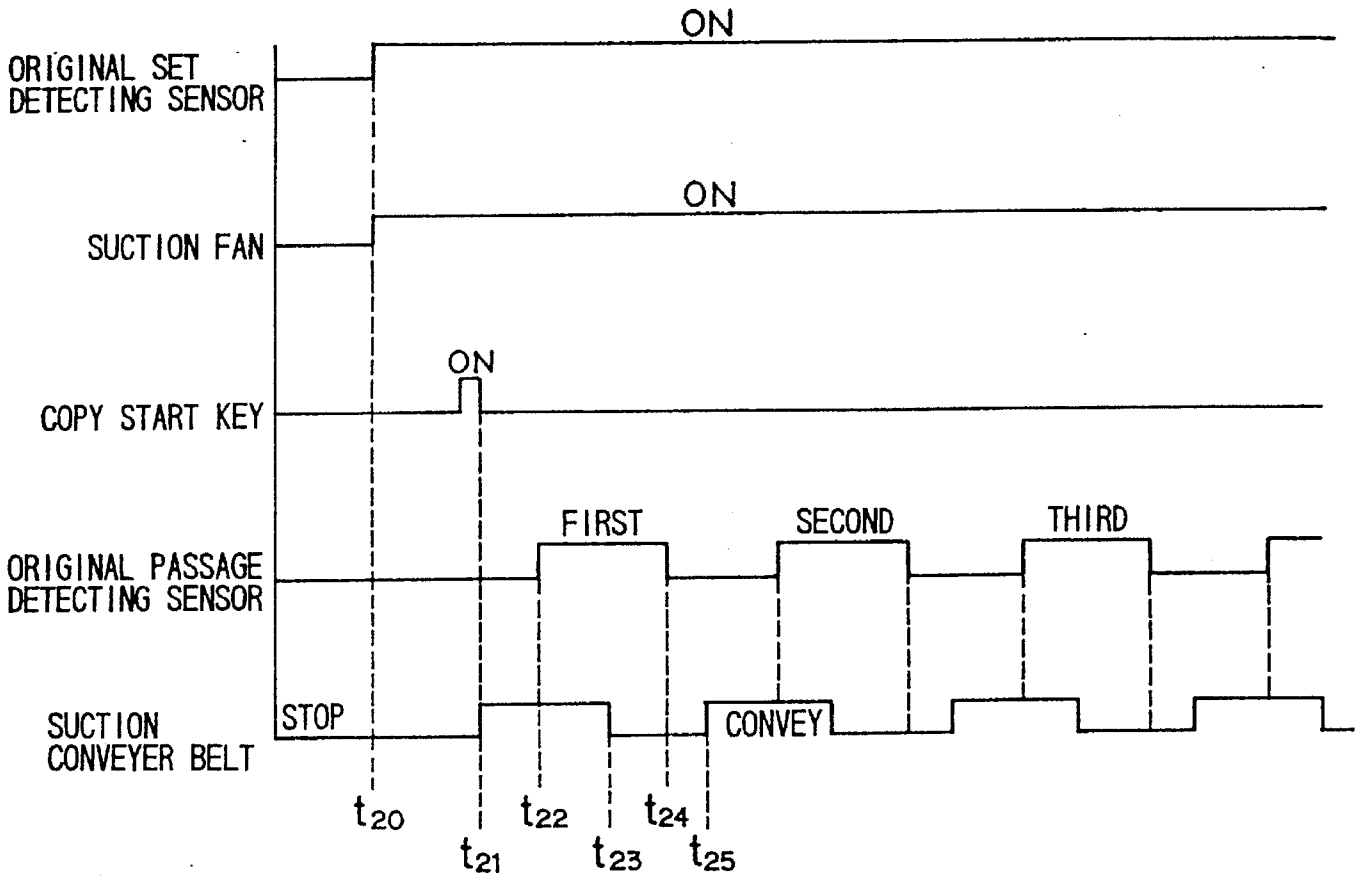
FIG. 25 is a timing chart showing an original feeding operation.

FIGS. 23 to 25 illustrate an embodiment in which the present invention is applied to the automatic document feeder. The construction of the automatic document feeder is the same as that in the above described embodiment (FIGS. 2 and 6 to 9) and has been already described and hence, the description thereof is not repeated. FIGS. 23 and 24 are flow charts showing operations performed by the RADF control section, and FIGS. 25 is a timing chart. Referring to FIGS. 23 to 25, control of an original feeding operation will be described.

First, if the copy mode, the copy size, the number of copies and the like are set by the operating section 1 (step S1), and the set of originals S on the original platen 11 is detected by the original set detecting sensor 840 (step S2, timing $t_{20}$ in FIG. 25), the suction fan 128 is started (step S3), and the original size is detected by the positions where the paper trailing end linear 111 and the paper side end linear 112 slide at the time of setting originals (steps S4 and S5). If the copy start key is turned on (step S6, timing $t_{21}$ in FIG. 25), the suction conveyer belts 121 to 124 are started so as to convey the first original (step S7).

If the leading end of the original S conveyed by the suction conveyer belts 121 to 124 passes through the original passage detecting sensor 830 (step S8), the suction conveyer belts 121 to 124 are stopped at timing $t_{23}$ after an elapse of a predetermined time period from timing of the passage $t_{22}$ (steps S9 to S11), after which the timer is reset. The above described timing of the stop $t_{23}$ is determined in the following manner. Specifically, timing at which the trailing end of the first original $S_1$ reaches the air suction port 127*b* is found on the basis of the timing $t_{22}$ at which the leading end of the first original $S_1$ reaches the original passage detecting sensor 830 and the original size detected by the original size detecting sensor 2, and the above described timing $t_{23}$ is set to timing before an elapse of a predetermined time period from the found timing. The timing $t_{23}$ is so set as to be timing at which the leading end of the first original $S_1$ has already reached the pair of delivery rollers 13. Since the suction conveyer belts 121 to 124 are stopped before the trailing end of the first original $S_1$reaches the air suction port 127*b* to open the air suction port 127*b*, the second original $S_2$ is prevented from being unnecessarily conveyed by the suction conveyer belts 121 to 124. The positional relationship between the air suction port 127 and the pair of delivery rollers 14 is so set that the paper sheet of the minimum size opens a part of the air suction port 127 since the conveyance of the original of the minimum size was started by the pair of delivery rollers 14.

If the trailing end of the original S then passes through the original passage detecting sensor 830 (step S14), the suction conveyer belts 121 to 124 are started so as to convey the subsequent original at timing $t_{25}$ after an elapse of a predetermined time period from timing of the passage $t_{24}$ (steps S15 to S17), after which the timer is reset (step S18). In such a manner, the operations in the steps S8 to S18 is repeated, to successively convey the originals. If the original passing through the original passage detecting sensor 830 is the final original, the suction fan 128 is stopped (step S19), to terminate the processing.

Also in the embodiment of the reversing automatic document feeder 10, exactly the same function and effect as those in the embodiment of the paper refeeding device 50 are produced. Specifically, the lowermost original $S_1$ sucked and conveyed by the suction conveyer belts 121 to 124 is received and conveyed by the pair of delivery rollers 14. The suction conveyer belts 121 to 124 which convey the lowermost original $S_1$ are stopped before a part of the air suction port 127*b* is opened so that the second original $S_2$ is adsorbed on the suction conveyer belts 121 to 124. Consequently, the second original $S_2$ is prevented from being unnecessarily conveyed by the suction conveyer belts 121 to 124, thereby to make it possible to reliably prevent the originals S from being fed with they overlapped with each other. Further, timing at which the air suction port 127*b* is opened is found in consideration of the original size. When a long original of A3 size, for example, is conveyed by the pair of delivery rollers 14, therefore, the original can be prevented from being rubbed against the suction conveyer belts 121 to 124 for an unnecessarily long time period.

Furthermore, the positional relationship between the air suction port 127*b* and the pair of delivery rollers 14 is so set that the original of the minimum size opens a part of the air suction port 127*b* since the conveyance of the original of the minimum size by the pair of delivery rollers 14 was started. Therefore, it is possible to prevent originals of the minimum size from being fed with they overlapped with each other.

Additionally, since the suction fan 128 continues to be driven even after the suction conveyer belts 121 to 124 are stopped, the second original $S_2$ is adsorbed on the stopped suction conveyer belts 121 to 124 and is thus reliably stopped. Consequently, it is possible to more reliably prevent the second original $S_2$, along with the lowermost original $S_1$, from being conveyed.

Furthermore, also in the reversing automatic document feeder 10, the same construction as that in the paper refeeding device 50 is employed with respect to the auxiliary suction port 127*d* of the suction duct 127 and the lamina 850 for opening and closing the same, whereby exactly the same function and effect as those in the above described embodiment are produced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet conveying device comprising:

a sheet table on which a plurality of sheets are stacked;

suction conveyer belt means comprising an endless suction conveyer belt having a plurality of small holes for successively conveying a lowermost sheet out of said sheets stacked on said sheet table along a conveying direction;

a suction duct disposed with it crossing said suction conveyer belt in a loop of the suction conveyer belt and having an air suction port in communication with said plurality of small holes formed on its upper surface;

sucking means for sucking air through said suction duct;

an air nozzle for blowing air on a leading end of said lowermost sheet to separate upper sheets from said lowermost sheet;

a guide duct for introducing the air sucked from said suction duct into said air nozzle; and an auxiliary suction port for ensuring in said suction duct an amount of air blown off from said air nozzle.

2. A sheet conveying device according to claim 1, wherein said auxiliary suction port is disposed in a position of said suction duct in a direction opposite to a direction of a flow of air in said suction duct as viewed from said air suction port.

3. A sheet conveying device according to claim 1, wherein said auxiliary suction port is provided with valve means for adjusting an opening ratio by a pressure differential across said auxiliary suction port.

4. A sheet conveying device according to claim 3, wherein said valve means is composed of a thin plate member having elasticity, one end of said valve means being mounted on said suction duct.

5. A sheet conveying device according to claim 1, further comprising;

leading end passage timing detecting means for detecting a time at which a leading end of a sheet conveyed from said suction conveyer belt means passes, and belt driving control means for finding a found time at which a trailing end of said sheet reaches said air suction port on a basis of the time at which said leading end of said sheet passes as detected by said leading end passage timing detecting means and a sheet size previously set, and for stopping driving of said suction conveyer belt means before elapse of a predetermined time period from said found time.

6. A sheet conveying device according to claim 5, further comprising delivery roller means for receiving a sheet conveyed from said sheet table by said suction conveyer belt and conveying said sheet, a positional relationship between said delivery roller means and said air suction port being so set that a sheet of a minimum size opens a part of said air suction port immediately after a conveyance thereof by said delivery roller means is started.

7. A sheet conveying device according to claim 5, further comprising sucking means driving controlling means for controlling a driving of said sucking means, said sucking means driving controlling means continuing to drive said sucking means even after the driving of said suction conveyer belt means is stopped.

8. A sheet conveying device according to claim 1, further comprising valve means provided in an air path between said air suction port of said suction duct and a suction fan for adjusting an amount of air sucked through said air suction port, and controlling means for controlling a driving of said sucking means and said valve means, said controlling means starting said sucking means in a state where an amount of sucked air is restricted by said valve means at a predetermined time before stacking a sheet which is to be said lowermost sheet on said sheet table and increasing an amount of sucked air by said valve means at a predetermined time after stacking said sheet which is to be said lowermost sheet.

9. A sheet conveying device according to claim 8, wherein said sheet table comprises a transfer sheet table on which transfer sheets each having a toner image transferred on one side through image forming means are successively stacked through a stacking and conveying path, and further comprising stacked sheet leading end passage timing detecting means disposed in a position of said stacking and conveying path in a direction opposite to a direction of conveyance to said transfer sheet table as viewed from said transfer sheet table for detecting timing at which a leading end of a transfer sheet passes, said controlling means starting said sucking means in a state where the amount of sucked air is restricted by said valve means in response to an image formation start signal, finding a found time at which a transfer sheet to be first stacked on said transfer sheet table has been stacked on a basis of a time at which a leading end of a transfer sheet to be first stacked passes, and increasing the amount of sucked air by said valve means at a time after an elapse of a predetermined time period from the found time.

10. A sheet conveying device according to claim 1, wherein said sheet table comprises a transfer sheet table on which transfer sheets each having a toner image transferred on one side through image forming means are successively stacked through a stacking and conveying path, and further comprising belt driving controlling means for driving said suction conveyer belt means so that the transfer sheets each having a toner image transferred on one side are sent out from said transfer sheet table while the transfer sheets are successively stacked on said transfer sheet table, said belt driving controlling means successively sending out said lowermost transfer sheet by said suction conveyer belt means so that said lowermost transfer sheet opens a part of said air suction port at a time after an elapse of a predetermined time period from time at which a transfer sheet to be stacked subsequently to said lowermost transfer sheet has been stacked, when a number of transfer sheets on which a toner image is to be transferred is not more than a previously set value.

11. A sheet conveying device according to claim 10, further comprising stacked sheet passage timing detecting means provided in said stacking and conveying path for detecting a time at which a predetermined portion of the transfer sheet to be stacked passes, said controlling means finding a a found time at which a transfer sheet to be stacked subsequently to said lowermost transfer sheet has been stacked on a basis of a time of a passage as detected by said stacked sheet passage timing detecting means if said number of transfer sheets on which the toner image is to be transferred is not more than said previously set value, and setting timing at which a conveyance of said lowermost transfer sheet is started on the basis of said found time and a previously set sheet size so that said lowermost transfer sheet opens a part of said air suction port a time after an elapse of a predetermined time period from said found time.

12. A sheet table on which a plurality of sheets are stacked;

suction conveyer belt means comprising an endless suction conveyer belt having a plurality of small holes for successively conveying a lowermost sheet out of said sheets stacked on said sheet table along a conveying direction;

a suction duct disposed with it crossing said suction conveyer belt in a loop of the suction conveyer belt and having an air suction port in communication with said plurality of small holes formed on its upper surface;

sucking means for sucking air through said suction duct an air nozzle for blowing air on a leading end of said lowermost sheet to separate upper sheets from said lowermost sheet;

leading end passage timing detecting means for detecting a time at which a leading end of a sheet conveyed from said suction conveyor belt means passes, and belt driving controlling means for finding a found time at which a trailing end of said sheet reaches said air suction port on a basis of the time at which said leading end of said sheet passes as detected by said leading end passage timing detecting means and a sheet size previously set, and for stopping driving of said suction conveyer belt means at a time before an elapse of a predetermined time period from said found time.

13. A sheet conveying device according to claim 12, further comprising delivery roller means for receiving a sheet conveyed from said sheet table by said suction conveyer belt and conveying said sheet, a positional relationship between said delivery roller means and said air suction port being so set that a sheet of a minimum size opens a part of said air suction port immediately after a conveyance thereof by said delivery roller means is started.

14. A sheet conveying device according to claim 12, further comprising sucking means driving controlling means for controlling a driving of said sucking means, said sucking means driving controlling means continuing to drive said sucking means even after the driving of said suction conveyer belt means is stopped.

15. A sheet conveying device comprising:

a transfer sheet table on which transfer sheets each having a toner image transferred on one side through image forming means are successively stacked through a stacking and conveying path;

a sheet table on which a plurality of sheets are stacked;

suction conveyer belt means comprising an endless suction conveyer belt having a plurality of small holes for successively conveying a lowermost sheet out of said sheets stacked on said sheet table along a conveying direction;

a suction duct disposed with it crossing said suction conveyer belt in a loop of the suction conveyer belt and having an air suction port in communication with said plurality of small holes formed on its upper surface;

sucking means for sucking air through said suction duct;

belt driving controlling means for driving said suction conveyer belt means so that the transfer sheets each having a toner image transferred on one side are sent out from said transfer sheet table while the transfer sheets are successively stacked on said transfer sheet table, said belt driving controlling means successively sending out said lowermost transfer sheet by said suction conveyer belt means so that said lowermost transfer sheet opens a part of said air suction port at a time after an elapse of a predetermined time period from time at which a transfer sheet to be stacked subsequently to said lowermost transfer sheet has been stacked when a number of transfer sheets on which a toner image is to be transferred is not more than a previously set value.

16. A sheet conveying device according to claim 15, further comprising stacked sheet passage timing detecting means provided in said stacking and conveying path for detecting a time at which a predetermined portion of the transfer sheet to be stacked passes, said controlling means finding a found time at which a transfer sheet to be stacked subsequently to said lowermost transfer sheet has been stacked on a basis of a time of a passage as detected by said stacked sheet passage timing detecting means if said number of transfer sheets on which the toner image is to be transferred is not more than said previously set value, and setting a time at which a conveyance of said lowermost transfer sheet is started on the basis of said found time and a previously set sheet size so that said lowermost transfer sheet opens a part of said air suction port at a time after an elapse of a predetermined time period from said found time.

* * * * *